US005950609A

United States Patent [19]

Thielen et al.

[11] Patent Number: 5,950,609

[45] Date of Patent: Sep. 14, 1999

[54] MULTIPLE DRAW ARCHERY BOW

[76] Inventors: Joseph M. Thielen, 3027 Cameron Ave. SE., Buffalo, Minn. 55313; William J. Drasler, 4100 Dynasty Dr., Minnetonka, Minn. 55345

[21] Appl. No.: 08/943,055

[22] Filed: Oct. 2, 1997

[51] Int. Cl.[6] ..... F41B 5/10

[52] U.S. Cl. ..... 124/25.6

[58] Field of Search ..... 124/25.6, 900

[56] References Cited

U.S. PATENT DOCUMENTS

| | | | |
|---|---|---|---|
| 3,987,777 | 10/1976 | Darlington . | |
| 4,471,747 | 9/1984 | Nishioka . | |
| 4,512,326 | 4/1985 | Jarrett . | |
| 4,530,342 | 7/1985 | Simo | 124/25.6 X |
| 4,603,676 | 8/1986 | Luoma | 124/25.6 X |
| 4,756,295 | 7/1988 | Guzzetta | 124/16 |
| 4,757,799 | 7/1988 | Bozek . | |
| 4,817,580 | 4/1989 | Butterfield | 124/25.6 |
| 4,903,677 | 2/1990 | Colley . | |
| 4,989,577 | 2/1991 | Bixby | 124/25.6 |
| 5,054,463 | 10/1991 | Colley | 124/25.6 |
| 5,150,699 | 9/1992 | Boissevian | 124/25.6 |
| 5,445,139 | 8/1995 | Bybee | 124/23.1 |

*Primary Examiner*—John A. Ricci

[57] ABSTRACT

A multiple draw archery bow having a single draw string that is drawn to a full drawn position a plurality of times providing energy of deformation to flexible bow limbs, storing the energy from each full draw using a mechanical mechanism such as a block and tackle mechanism, and providing the stored deformation energy back to the same draw string for launching the arrow with a force and a velocity that is greater than can be derived from a single full draw of a draw string from a standard compound bow that allows only one full draw of the draw string. The mechanical mechanism allows the archer to draw the draw string of the multiple draw bow to a plurality of full drawn positions with a lower average draw force than a standard compound bow that launches an arrow at the same launch velocity as the present multiple draw bow.

31 Claims, 32 Drawing Sheets

50
485
480
470
475
195
490
495
135
20
500
145
50
435
345
340
410
255
320
230
505
375
365
350
310
360
370
35
315
385
420
235
430
135
20

5
6&7

235
310
520
415
230
145
140
510
420
515
6&7
5

MULTIPLE DRAW ARCHERY BOW

BACKGROUND OF THE INVENTION

1. Field of Invention

The present invention relates to an archery bow, and more particularly to a compound bow with a mechanical mechanism that is drawn to a full drawn position a plurality of times with a greater storage of energy and with a lower draw force than a standard compound bow that requires only a single draw.

2. Description of Prior Art

Compound bows are often used in archery due to their favorable force-draw curve for draw force versus draw length. They allow the archer to draw the draw string back with an increasing draw weight until a peak weight is attained and thereafter the draw weight drops to a minimum draw weight at full draw. This drop off in draw force is referred to as let-off and allows the archer to hold the draw string at full draw for an extended period until the appropriate time to launch the arrow. The mean draw weight applied by the archer lies between the peak draw weight and the minimum draw weight. To obtain the favorable force-draw curve and let-off found in compound bows typically a cam-shaped pulley is mounted at the end of each bow limb to provide the draw string with a lever arm that is greatest in the full drawn position. The cam-shaped pulleys also require syncronization with each other such that the lever arm that they offer to the draw string is the same throughout the launch period for each of the bow limb mounted cam-shaped pulleys.

As the archer applies a draw force to the draw string for a draw length, he imparts an amount of energy equal to the multiplication product of the force and draw length. This energy is stored as potential energy of deformation in the flexible bow limbs as they are deformed from a static state to a dynamic or final state of deformation. When the draw string is released, a return launch force is applied by the draw string onto the arrow causing it to accelerate reaching a final launch velocity such that a greater mean draw force will result in a greater mean return launch force being applied to the arrow during launch and a greater launch velocity. The deformation energy stored in the flexible limbs in bringing the draw string back to a full draw is thereby converted into kinetic energy of the launched arrow generating this arrow velocity. The greater the amount of mean draw force and hence stored deformation energy in the flexible bow limbs, the greater will be the velocity of a particular arrow that is launched. A higher arrow velocity is advantageous since it results in a lower trajectory for the arrow during flight and hence allows the archer to gain accuracy at a larger distance.

A standard compound bow that is 100% efficient would therefore impart a kinetic energy to a launched arrow that is equivalent to the energy imparted by the archer during a single full draw stroke. A compound bow, however, typically contains dynamic viscosity energy losses associated with the movement of the limbs, cams, pulleys, and other moving components of the bow accounting for approximately 15% energy loss. As a result, a compound bow will deliver almost as much energy to launch the arrow as was imparted by the archer and stored in the limbs during the drawing of the bow to a single full draw. Using standard compound bows that require one single draw, arrow velocities attained by an archer of greater strength only provide an accuracy in hunting at approximately 20 yards or less. To increase the arrow velocity using a standard compound bow requires that the mean draw force be increased beyond the typical strength capabilities of most archers. Less powerful archers including most women and children are unable to generate the forces necessary during the draw of the bow to result in arrow velocities required for long distance accuracy desired in hunting and in target shooting.

Several approaches have been tried to provide a bow that requires a lower draw force or that store the draw energy with various types of springs. Most of these devices, however store the energy from only a single draw of the draw string, and those devices that provide for a plurality of draws are either cumbersome or require external hydraulic systems to generate the draw energy. One bow has been described which provides a means for improving or modifying energy storage. U.S. Pat. No. 4,471,747 issued to Nishioka stores preloaded energy in a bow which can be recovered at a later time. The mechanism only stores energy of a single pull, however. In Nishioka's first embodiment he describes a device that stores energy of one draw in the limbs by latching an eccentric cam in the let-off position. To launch the arrow, the draw string is pulled back a small amount further to unlatch the latch. In Nishioka's second embodiment he describes a device that again stores energy of one draw in the limbs, although the bow is further equipped with a fluid pump which pushes a piston directly against a pivoting limb as the bowstring is held in its extented position in the let-off region. This bow requires an outside hydraulic source of energy that produces a pumping action on a fluid cylinder to flex a pivoting lower limb. Such hydraulic systems tend to be prone to leakage, are temperature dependent, and are less desirable than standard mechanical systems. The hydraulic pumping action described by Nishioka could not be performed with a let-off of force as found in standard compound bows. Nishioka's bow would thereby require an excessive number of pumping steps or an extremely high draw force for a small number of pumping steps.

Another approach for storing energy in a bow is described by U.S. Pat. No. 4,757,799 issued to Bozek. Bozek requires that two strings be pulled in order to launch an arrow, a bending bowstring and a launching string. Not only is it awkward to pull back two strings at the same time, one of which contains an arrow attached, but the force of each consecutive pull becomes harder than the previous one. Bozek's design further contains problems as the archer releases the two strings related to the return of the two strings to their starting positions resulting in undesireable bow function. The presence of the two strings that are required to be drawn back at the same time by the archer will also negatively affect the accuracy of arrow launch.

Colley describes in U.S. Pat. No. 5,054,463 a bow with a cam located near the riser to provide a let-off or reduced holding force at full draw. Colley further describes a flat wound coil spring that stores the energy of a single draw of the draw string and delivers it back to propell the arrow.

U.S. Pat. No. 3,987,777 issued to Darlington describes a force multiplying type of archery bow with eccentrically mounted pulleys at each end of the handle and provides a reduced holding force at the end of the single draw.

Bixby describes in U.S. Pat. No. 4,989,577 a bow with limbs attached to the handle with a pivot that is spring loaded. Drawing back the bowstring stores energy in the spring but only a single draw of energy is stored.

Several other bows have been described by Colley (U.S. Pat. No. 4,903,677), Jarrett (U.S. Pat. No. 4,512,326), Guzzetta (U.S. Pat. No. 4,756,295), and Boissevian (U.S.

Pat. No. 5,150,699) that comprise coil springs, levers, and pivots to provide a significant reduction in draw force or let-off of force in the fully drawn position. All of these devices involve a single draw of the draw string and hence can only store the energy of a single draw.

In U.S. Pat. No. 5,455,139, Bybee describes a cross bow that contains fluid cylinders that push against the middle of bow arms to create increased tension in the bowstring. The system employs an additional hydraulic system to generate the additional energy. Application of Bybee's system to an archery bow or compound bow would create an exceedingly high holding force at full draw since Bybee could not combine any let-off means with the design, and requires a stock assembly to hold the draw string.

Other factors that affect the speed and accuracy of standard compound bows can be related to the cam shaped pulleys located on one or both of the bow limbs of standard compound bows requiring a single draw. These cam-shaped pulleys are usually larger than a small round pulley and hence have a somewhat larger mass. The mass can influence the speed of the bow limb as it returns from its full drawn dynamic state of deformation back to its resting state, making it slower and making the bow limb vibrate more than desired. In a typical compound bow it is also necessary that each of the two bow limbs be constructed similarly such that each bow limb provides similar deformation during the draw of the draw string and return back to their starting position in a similar manner. Attempts have been made to resolve some of these issues however none of the prior art inventions provide a plurality of draws of a single draw string using a mechanical means and launch an arrow using the same draw string.

SUMMARY OF THE INVENTION

Application of block and tackle principles

The present invention overcomes the disadvantages of prior art compound bows that are cumbersome to use, require a hydraulic system, or require that two bow strings be drawn back in order to launch an arrow. The present invention is a multiple draw archery bow that requires multiple draws of only one single draw string to a full drawn position and launches an arrow with the same draw string. Each full draw stores deformation energy in the flexible limbs providing a total energy storage from the plurality of full draws to be converted and delivered to launch the arrow at a higher velocity than a standard compound bow that allows only one draw of the draw string. The archer requires a lower mean draw force for each of the plurality of full draws than would be required for a similar total energy storage from one draw of a standard compound bow of the same draw length. A block and tackle mechanism is used to provide the lower mean draw force over a plurality of full draws required by the multiple draw bow of this invention.

The structure of the bow is similar to a standard compound bow with a handle-riser with flexible limbs affixed to each end and with a force-draw curve that provides a let-off of force as the archer approaches the full drawn position for each of the plurality of full draws. The multiple draw bow of this invention differs from a standard compound bow due to the presence of a block and tackle mechanism attached to the handle-riser to provide the archer with the ability to deliver a greater force to launch an arrow than with a standard compound bow.

The block and tackle principle that is being applied to the present device involves a mechanical pulley system used to store potential energy as deformation energy of the flexible limbs. Deformation energy is stored by exerting a draw force for a specific distance, the energy being equal to the multiplication product of draw force and distance. A block and tackle system allows a smaller draw force that is exerted over a greater distance to store an equivalent amount of potential energy as a greater draw force exerted for a smaller distance. This principle can be applied to one embodiment of the bow of this invention that requires two draws by providing the appropriate block and tackle mechanism. An intermediate draw force exerted by an archer on the draw string for two draws is approximately one half the normal draw force for a standard compound bow but it is exerted over twice the distance, by pulling the draw string back to a full draw two times. The draw energy from each of a plurality of draws is being stored in the flexible limbs as deformation energy and is later converted to kinetic energy of the arrow during launch. The block and tackle principle can be applied equally well to alternate bow embodiments some of which require three or more draws.

Operational procedure

Initially, in the undrawn state, the draw string is in a resting position and the flexible limbs of a compound bow contain a small static amount of stored potential energy associated with limb deformation during bow stringing. After the first full draw of the present invention the draw string is returned to a second resting position and the bow limbs are deformed and held automatically with an intermediate amount of deformation and with an intermediate amount of potential energy of deformation stored in the flexible limbs. After the second full draw, the flexible limbs have been deformed to their final or dynamic deformation and have stored an additional final amount of potential energy of deformation associated with the second full draw. As the arrow is launched after the second full draw, total potential energy, stored from both the first and second full draw is converted into kinetic energy of the arrow. A safety release is activated by the archer following the second full draw allowing the deformation energy stored from the first full draw to become available and combined with the deformation energy from the second full draw to launch the arrow.

The bow of the first embodiment of the present invention requires two full draws of the draw string prior to launching the arrow, each draw occurring at an intermediate force that is well tolerated by an archer of average strength. The first full draw deforms the flexible limbs to approximately one-half of their final deformation and stores approximately one-half of the total deformation energy that is stored in the flexible limbs after two full draws. The second full draw deforms the flexible limbs further into their final deformation state and stores approximately one half of the total deformation energy stored in the flexible limbs. The total amount of deformation energy stored in the flexible limbs is equal to the sum of the deformation energy from the first and second full draw.

This invention is not limited to only two full draws of the draw string. The block and tackle principle described can be applied to three full draws of the draw string with each full draw storing approximately one third of the total stored energy or four draws with each draw storing approximately one forth of the total energy. The principles described in this invention apply to a bow that requires a plurality of draws of the draw string at an intermediate force with a mechanical mechanism to store deformation energy in the flexible limbs and then release all of the stored deformation energy to the draw string to launch an arrow at greater force than could be generated with only a single draw of the draw string.

Bow structure

The block and tackle mechanism of the present invention is a mechanical mechanism such as a differential windlass to accomplish a lower draw force for two full draws of the draw string than the draw force of a standard compound bow. The mechanical mechanism has two cam pulleys which together form a tackle pulley means that attaches to each end of a tackle line, or other cable means that passes through a block pulley positioned on the end of each flexible limb. Each end of the draw string attaches to a draw pulley mechanism which is also part of the mechanical mechanism. The draw string passes through idler pulleys which are generally round axisymmetric pulleys one mounted at the end of each flexible limb in the primary embodiment of this invention.

The present invention provides that the idler pulley and the block pulley positioned on a limb are each attached to a pivotable linkage that is then pivotally attached to a flexible limb. This pivotable linkage provides an automatic adjustment for the positions of the idler pulley and block pulley with respect to the flexible limb during each full draw of the draw string. The linkage provides for a constant length loop for the draw string for each resting position or for each full drawn position. The constant length loop allows each draw of the draw string to contribute maximally to the deformation energy storage in the flexible limbs during each draw. The linkage further provides the draw string with a linear axial movement of the nocking point of the draw string in the direction of arrow launch to enhance the accuracy of the bow.

The bow of the present invention provides let-off at a full drawn position for both the first and second full draw. Cam pulleys, eccentric pulleys or variable radius pulleys that provide the let-off of force in the present invention are located as part of the block and tackle mechanism. This mechanism is not required to be located on the bow limbs as with a typical standard compound bow, but rather is attached to the handle-riser of the bow. The present invention provides for lightweight flexible limbs by placing the cam away from the flexible limbs. This placement reduces the weight of the flexible limbs and hence increases flexible limb velocity and reduces the amount of limb vibration by reducing limb mass. Locating the cam pulleys on the block and tackle mechanism attached to the handle riser provides several advantages. Only simple round pulleys are required at the end of each flexible limb to hold the draw string. Such pulleys can be constructed with less mass than a cam pulley and hence would have less momentum allowing the flexible limbs to move back to their static position as an arrow is launched. The bow of this invention is therefore capable of delivering the draw string back to its initial or first resting position at a faster velocity and the result is a faster arrow velocity.

The simple pulleys located on the flexible limbs of this invention do not require syncronization as is required of some standard compound bows with two cam pulleys, one on each bow limb. This reduces the amount of adjustment required by the archer to tune the bow of this invention. Let-off for each of the plurality of draws of the present bow is provided by the cam pulleys which attach to the two ends of a tackle line or other cable means and are part of the block and tackle mechanism. The tackle line is directed through block pulleys located near the end of each flexible limb. The flexible limbs are flexed as the cam pulleys are activated by the block and tackle mechanism to take up the tackle line during the first and second full draws of the draw string for the first embodiment of the present invention. Following the second full draw, a safety release can be activated digitally by the archer to allow the deformation energy stored in the flexible limbs from both the first and second draw to be available for delivery from the flexible limbs to the draw string and converted into kinetic energy of the arrow. The safety release is a lever, cable, or latch release mechanism that is activated at the end of the second full draw. The final force exerted upon the arrow during the arrow acceleration just prior to arrow departure from the draw string will be approximately double an intermediate force that was exerted by the archer during each of the two full draws. This increase in delivery force causes the arrow to travel at an exit launch velocity from the bow much greater than what the velocity could be from just one of the draws of the draw string.

In the bow of this invention deformation energy is stored in the flexible limbs and hence each flexible limb will become deformed during the first and second full draw. The draw string passes through idler pulleys located on each of the bow limbs that are maintained by the pivotable linkage at approximately a fixed distance of separation in both the resting and full drawn position of the draw string. The idler pulleys are also maintained at approximately a fixed distance from the centerline of the bow as defined by the line of travel of the arrow during launch. The draw string forms a constant length loop from the point of attachment on the draw pulley mechanism, through an idler pulley located on one flexible limb, through an idler pulley located on the other flexible limb, and back to the draw pulley mechanism. This constant length loop has approximately the same perimetric length for the first and second resting positions and the same perimetric length for the first and second full drawn positions. This allows the draw string to be drawn to the first full draw or the second full draw using the full draw stroke to store energy in the flexible limbs. The draw string forms an equal pair of perimetric lengths extending from the nocking point through an idler pulley located on either flexible limb, to the draw pulley mechanism. The nocking point of the draw string of the present invention will thereby be required to move in a direction parallel to arrow travel. It is furthermore not necessary for each of the flexible limbs to be precisely matched in their flexibility characteristics in order to ensure accurate arrow launch with movement of the nocking point of the draw string in a straight line without fluctuations perpendicular to the line of arrow flight.

Multiple draw archery bow operation

To use the bow of the first embodiment of the present invention, the draw string is pulled back to a first full draw. This directly causes a draw pulley mechanism to rotate. The draw pulley mechanism rotation causes rotation of a first cam pulley which results in take-up of tackle line. The first cam pulley provides let-off for the first draw. Tension in the tackle line generates a bending in the flexible limbs which stores draw energy from the first draw as deformation energy of the flexible limbs. Energy is stored in the flexible limbs by fixing the first cam pulley automatically with respect to the handle riser at the end of the first full draw. The first cam pulley is fixed in position automatically without additional action of the archer when the draw string is in the first full draw position. The draw string returns to the second resting position or second undrawn position and is ready for the loading of an arrow and the second draw. The return of the draw string to a second resting position is accomplished with a take-up spring, or other take-up mechanism means of return. The second draw again rotates the draw pulley mechanism which causes rotation of a second cam pulley. The second cam pulley provides let-off for the second draw. While in the let-off position of the second draw, a safety release is activated by the archer which allows the stored deformation energy from the first draw to become available along with the stored deformation energy from the second draw and the total deformation energy stored in the flexible limbs is ready for delivery to launch the arrow when the archer releases the draw string.

If the archer decides not to launch the arrow after the second draw, deactivation of the safety release will allow him to return the drawstring to the undrawn second resting position at an intermediate force. In this manner, the draw string can be returned and the archer can wait until he wishes to shoot before performing the second full draw. For bowhunting the archer can have the first full draw already complete while waiting for the arrival of the prey. This allows approximately one half of the total potential energy to be stored in the flexible limbs. The draw string returns back to the second resting position and awaits the second draw. An arrow can then be loaded onto the nocking position of the draw string awaiting the arrival of the prey. The second draw is made at the appropriate time to store the second half or final deformation energy with the arrow in place. The safety release is activated digitally by the archer while at the second full draw in the let-off position. The arrow is then launched with the stored deformation energy of both draws and with an average launch force imparted to the arrow that is greater than an average draw force generated by the archer during either draw of the draw string.

Other embodiments

The second embodiment of the present invention takes the first embodiment previously described and adds two rigid limbs, one on each end of the handle-riser. Idler pulleys which provide passage for the draw string are positioned with one pulley at the end of each rigid limb. The flexible limb and rigid limb located on one end of the handle-riser can be considered a structural means which provides attachment for the block pulley and the idler pulley, respectively. The rigid limb is required to provide structural support to the idler pulley holding it in a position such that an arrow can be readily attached and launched. The flexible limbs are required to hold the block pulleys in position plus store energy of deformation. Since the draw string passes through idler pulleys that are positioned on rigid limbs, the pay-out of draw string from the draw pulley mechanism is equal through each idler pulley. Similarly, the take-up of draw string during arrow launch is also equal through each idler pulley causing the nocking point of the draw string to travel in a straight line in the direction of arrow launch. The rigid limbs also provide that each full draw of the draw string can be made with the same draw length for reasons similar to those described for the primary embodiment. This maximizes the amount of draw energy that can be exerted and converted to deformation energy of the flexible limbs for each draw of the draw string Other bow configurations can also be successfully employed using the same block and tackle mechanism that has been described. For example, the bow of the present invention could also comprise only one flexible limb along with a rigid limb that supports the draw string and a handle-riser to support the block and tackle mechanism. The single flexible limb could effectively store the same deformation energy that is stored by two flexible limbs. This can be accomplished by either deforming a single flexible limb to a greater amount of deformation or by providing a stiffer flexible limb that stores a greater energy for a smaller bending deformation. These other bow configurations are intended to be included in the overall teachings of the present invention.

BRIEF DESCRIPTION OF THE DRAWINGS

Other objects of the present invention and many of the attendant advantages of the present invention will be readily appreciated as the same becomes better understood by reference to the following detailed description when considered in connection with the accompanying drawings, in which like reference numerals designate like parts throughout the figures thereof and wherein.

DESCRIPTION OF THE PREFERRED EMBODIMENTS

Figure 1A:
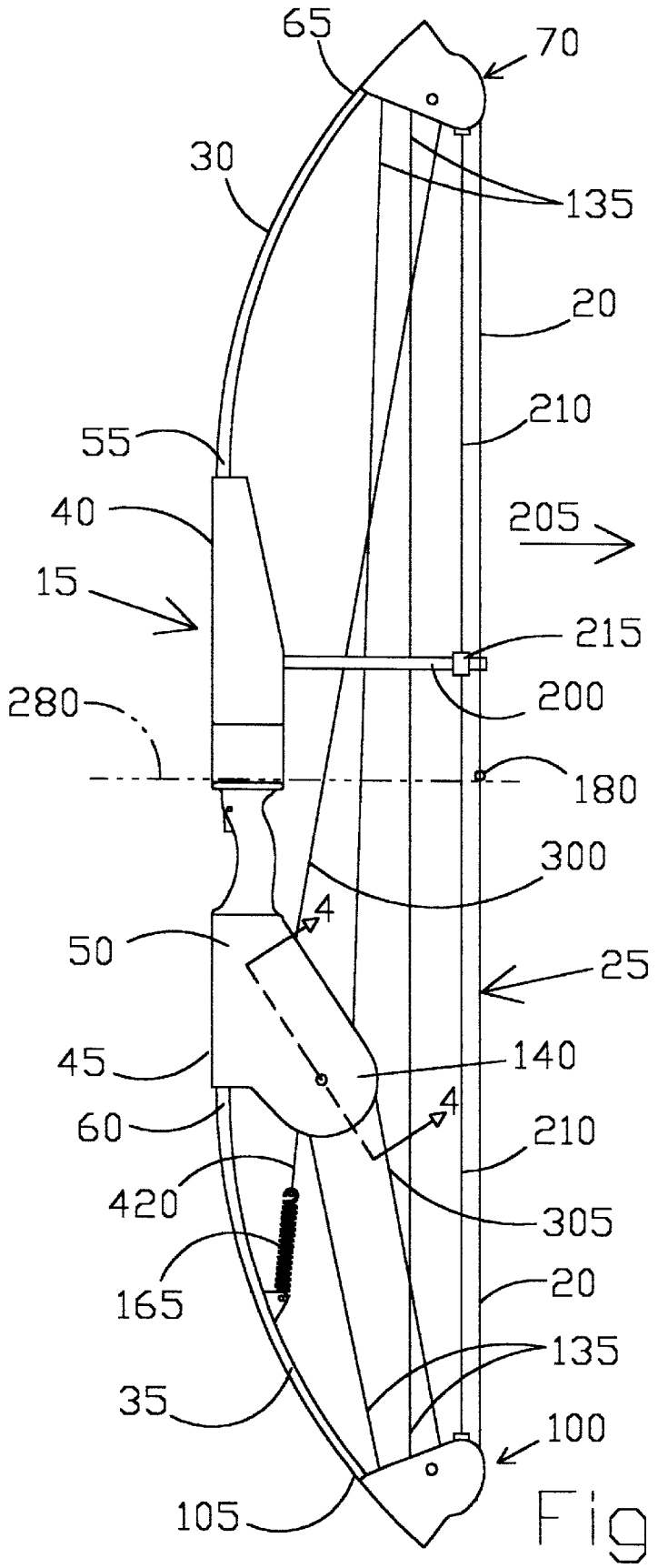
FIG. 1A is a plan view of the primary embodiment of the bow of this invention in a first resting position.
Figure 1B:
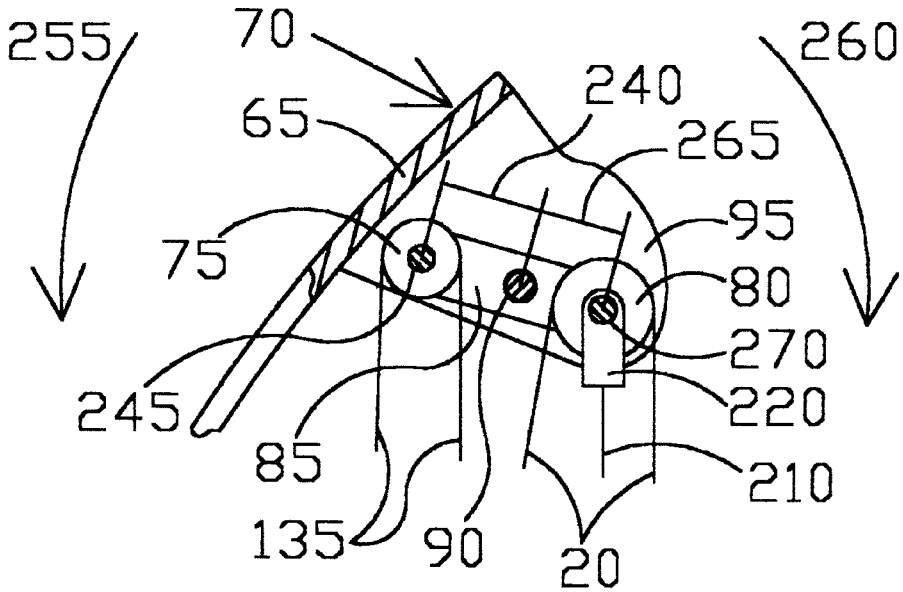
FIG. 1B is a partially sectioned view of an upper pulley assembly in a first resting position.
Figure 1C:
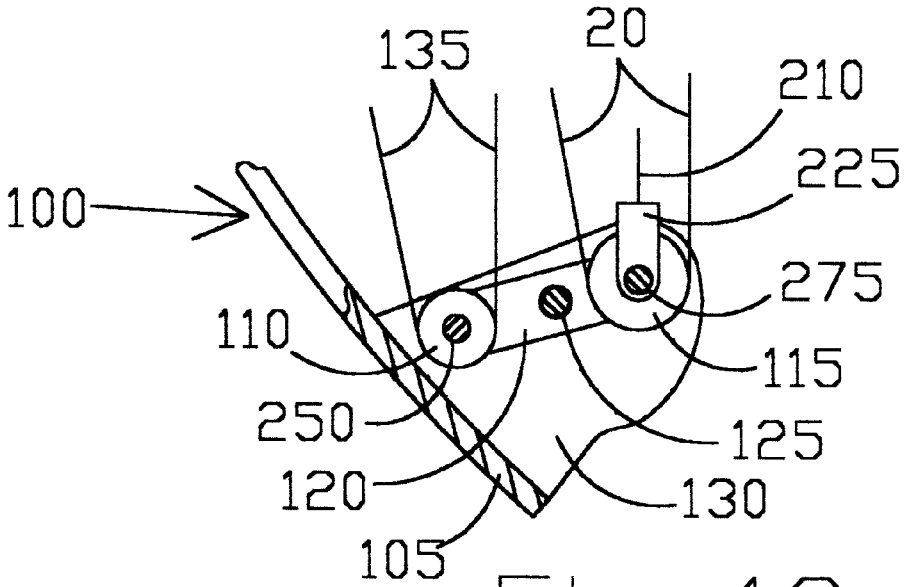
FIG. 1C is a partially sectioned view of a lower pulley assembly in a first resting position.
Figure 1D:
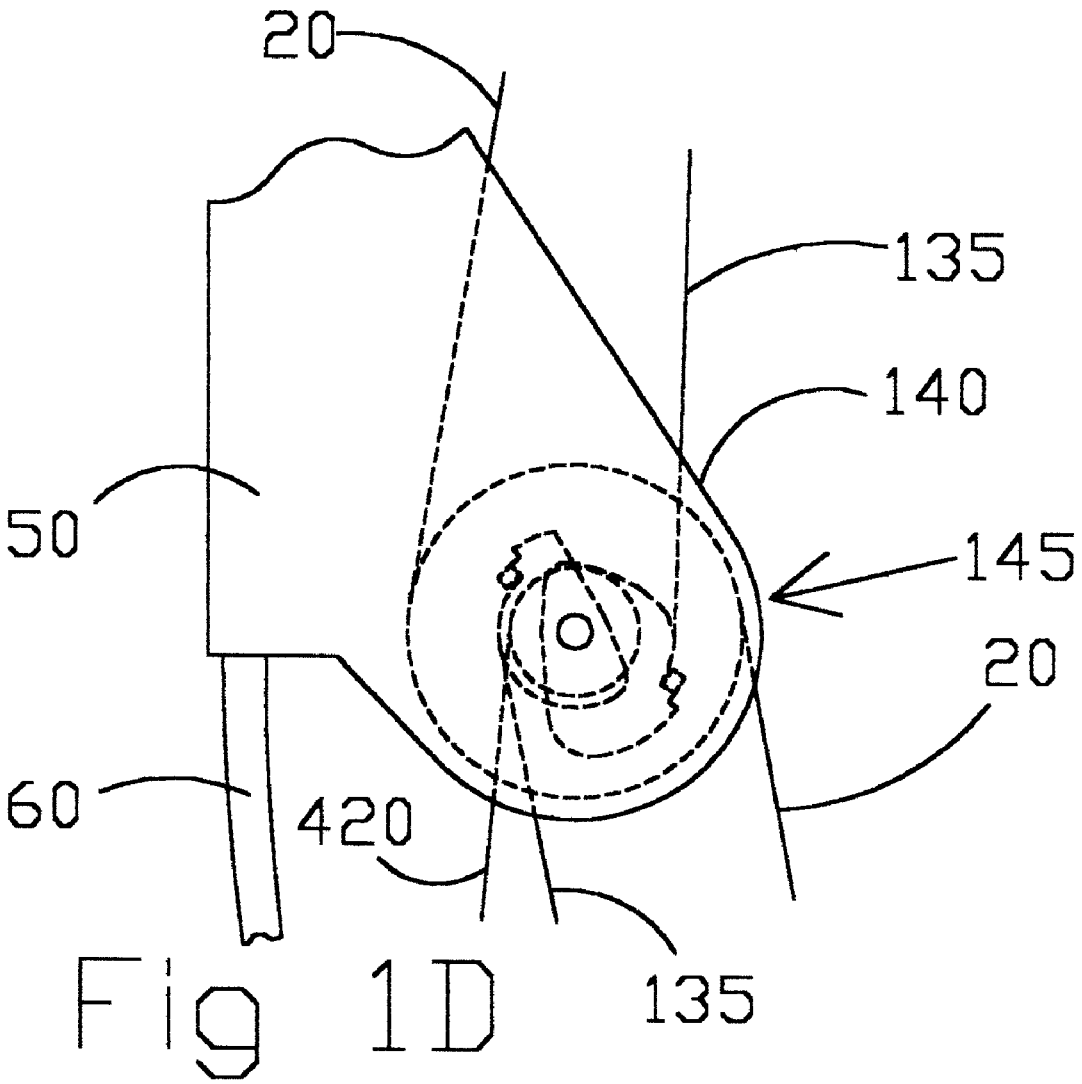
FIG. 1D is an enlarged plan view of a block and tackle mechanism attached to a handle-riser.

FIG. 1A is a plan view of the primary embodiment of a multiple draw bow 15 of this invention. FIGS. 1A–1I will be discussed together in describing this first embodiment. A draw string 20 is shown in a first resting position 25 prior to a first full draw of the draw string. Upper 30 and lower 35 flexible limbs are in an initial or static state of deformation with a small amount of deformation being imparted to the flexible limbs 30 & 35 during bow stringing. Upper 40 and lower 45 ends of a handle-riser attach rigidly to upper 55 and lower 60 fixed ends of the flexible limbs, respectively.

At a free end 65 of the upper flexible limb 30 is attached an upper pulley assembly 70 (FIG. 1B) which comprises an upper block pulley 75 and upper idler pulley 80. The upper block pulley 75 and upper idler pulley 80 are rotatingly attached to an upper pivoting linkage 85 which is pivotally attached by an upper pivoting linkage pivot 90 to an upper limb clevis 95. The pivoting linkage pivot 90 is located between the block pulley 75 and the idler pulley 80 and is shown located nearer to the idler pulley 80. The upper limb block clevis 95 is rigidly attached to the free end 65 of the upper flexible limb 30.

A lower flexible limb 35 has a lower pulley assembly 100 (FIG. IC) that is attached in a manner similar to the upper flexible limb 30 at a lower flexible limb free end 105 and comprises a lower block pulley 110, a lower idler pulley 115, a lower pivoting linkage 120, a lower pivoting linkage pivot 125, and a lower limb block clevis 130. The upper 80 and lower 115 idler pulleys provide for passage of the draw string 20 and the upper 75 and lower 110 block pulleys provide for passage of a tackle line 135.

Attached to the handle-riser 50 (FIG. ID) is a block and tackle mechanism housing 140 which houses a block and tackle mechanism 145 that will be discussed in more detail in FIGS. 3, 4, 5, 6, and 7. The function of the block and tackle mechanism 145 is to provide the bow of this invention with the capability of drawing the draw string 20 to a full draw for a plurality of draws at an intermediate draw force, storing draw energy from each full draw in the form of potential energy of deformation of the flexible limbs 30 & 35, and then allowing all of the stored energy to be delivered back through the draw string 20 into kinetic energy to launch an arrow with a greater force and greater velocity than could be achieved with only one draw of the draw string 20.

The intermediate draw force required by the bow 15 of this invention represents a lower integrated average force applied over the length of draw for each of the plurality of full draws than an integrated average force applied over a single draw length from a standard compound bow providing only a single draw of the draw string and each bow launching an arrow with a similar velocity. The energy imposed by the archer to draw back the draw string to a full drawn position is referred to as the draw energy and is equal to the multiplication product of the integrated average draw force times a draw length. A force imparted onto an arrow during launch can be termed a launch force. The integrated average launch force multiplied by the distance over which the launch force is applied is equal to the kinetic energy imparted to the arrow. The kinetic energy imparted to the arrow is slightly less than the draw energy due to losses incurred by dynamic viscosity and friction found in moving components. In the bow of this invention the draw string 20 is drawn at a draw force of lower integrated average value applied over a distance equivalent to two full draw lengths. The draw energy is delivered from the draw string through the block and tackle mechanism 145 to the tackle line 135 and stored in each of the two flexible bow limbs 30 & 35 as deformation energy. This deformation energy is then delivered back from the flexible limbs 30 & 35 to the tackle line 135 through the block and tackle mechanism 145 and delivered to the draw string 20 which imparts a larger launch force to launch the arrow with kinetic energy. The distance of travel over which the launch force is applied is equal to only one full draw length. The block and tackle mechanism 145 is a mechanical mechanism described in detail in FIGS. 3–7; the mechanical mechanism provides for at least two full draws of the draw string prior to launching the arrow. It is understood that the block and tackle mechanism 145 described herein can also be applied to three or four full draws of the draw string 20 prior to launching the arrow.

The draw string 20 is drawn back from a first resting position 25 as shown in FIG. 1*a* to a first full drawn position 150 (FIG. 1E) causing both flexible limbs 30 & 35 to undergo deformation from a static state of deformation 155 to an intermediate state of deformation 160. FIGS. 1F & 1G show the pivoting linkages 88 & 120 with the bow 15 in the first full drawn position as they maintain a constant length loop for the draw string for each full drawn position. A latch means found in the block and tackle mechanism 145 automatically holds the limbs in this intermediate state as shown in FIG. le and will be described further in FIG. 3E. A return spring 165 attaches to the flexible limb 35 at an attachment site 170 and provides the force necessary to return the draw string 20 back to a second resting position 175 shown in FIG. 1H.

Figure 1E:
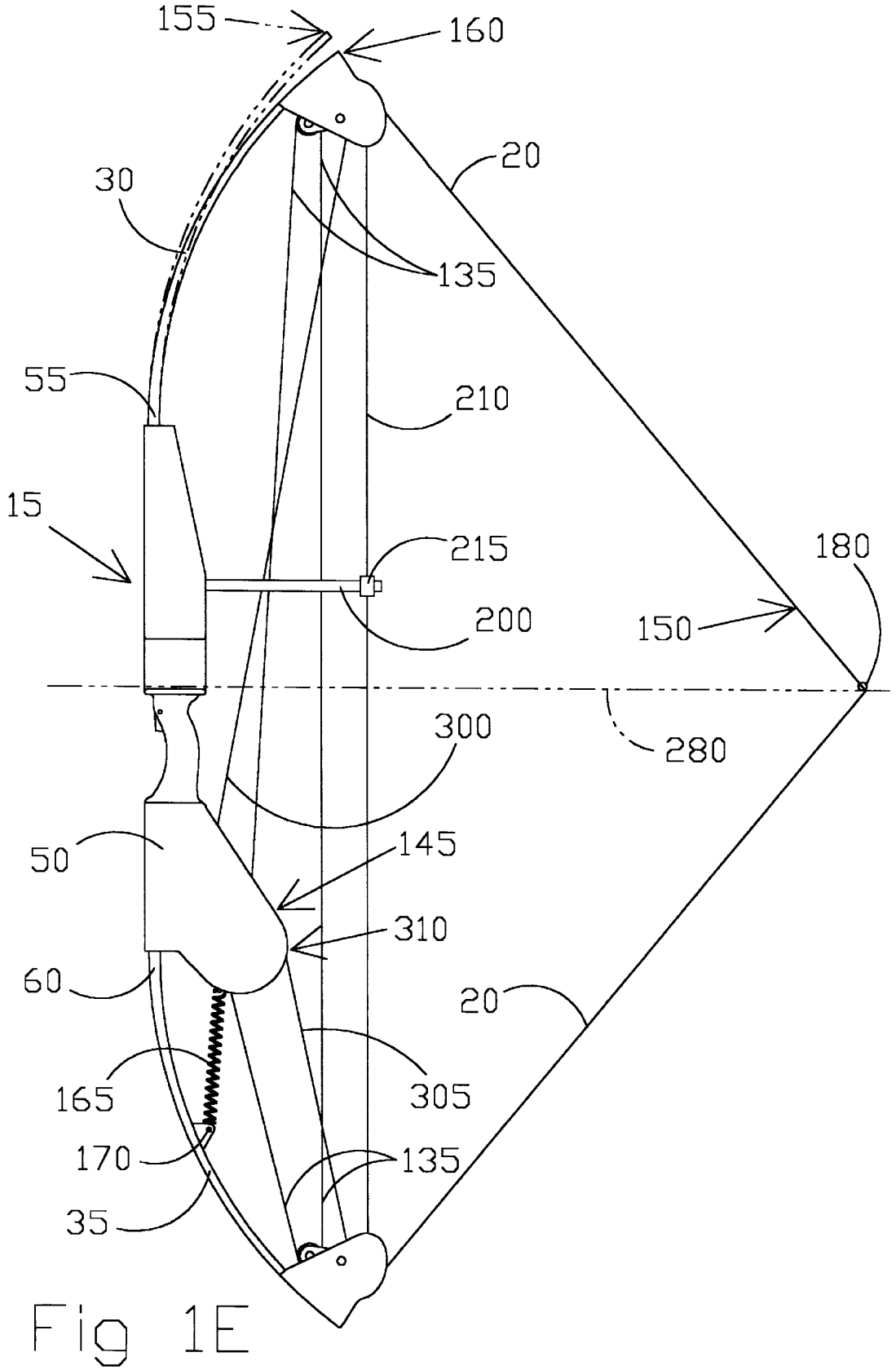
FIG. 1E is a plan view of the bow of this invention in a first full drawn position.
Figure 1F:
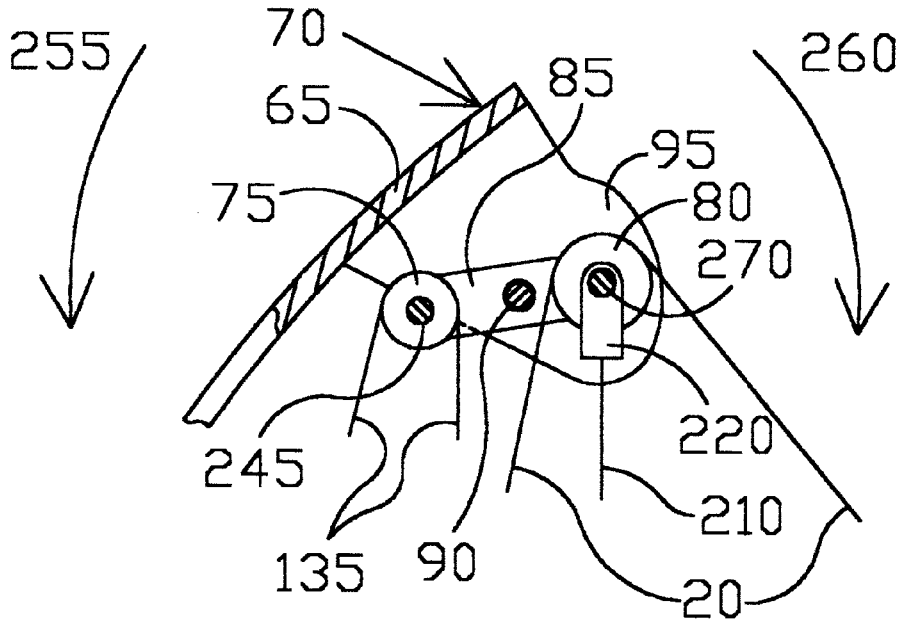
FIG. 1F is a partially sectioned view of an upper pulley assembly in a first full drawn position.
Figure 1G:
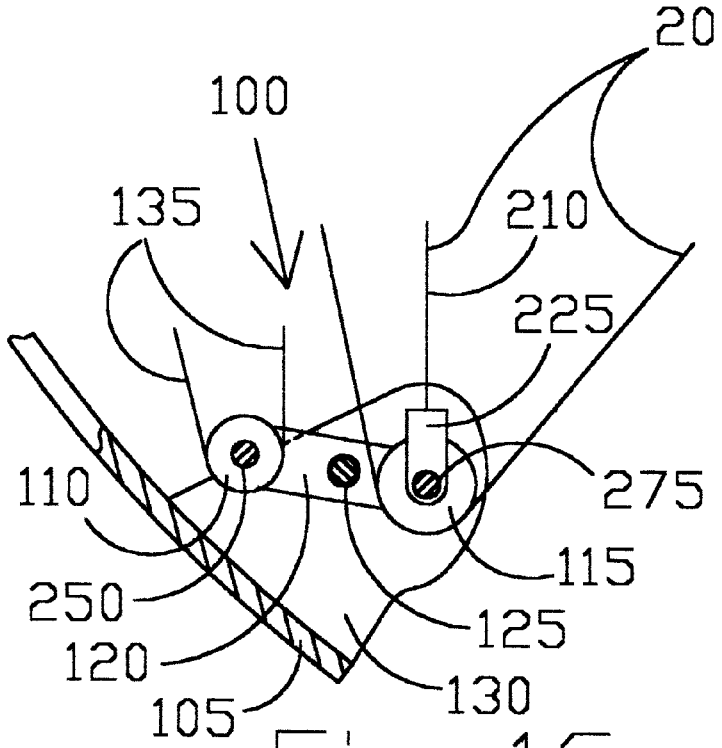
FIG. 1G is a partially sectioned view of a lower pulley assembly in a first full drawn position.
Figure 1H:
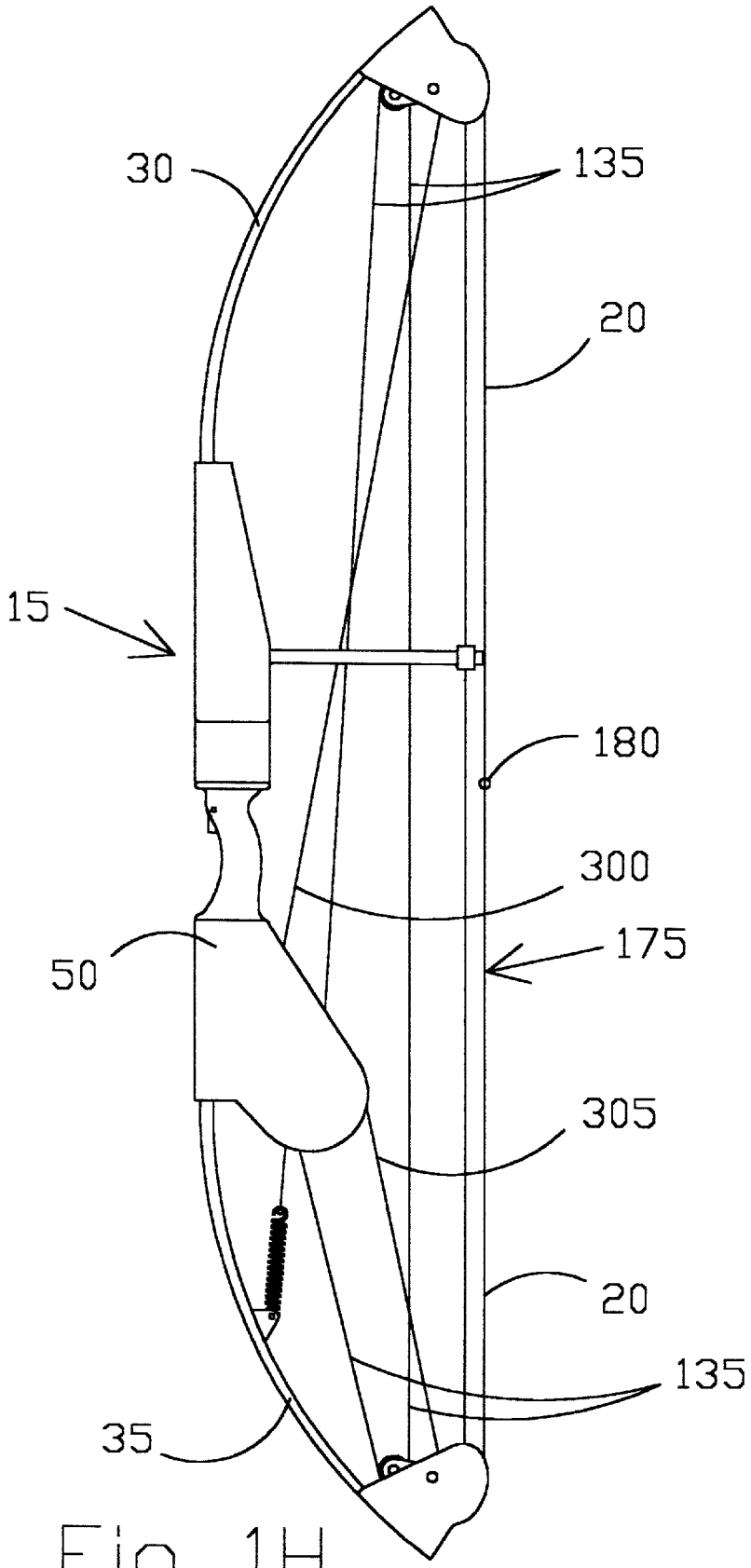
FIG. 1H is a plan view of the bow of this invention in a second resting position.
Figure 1I:
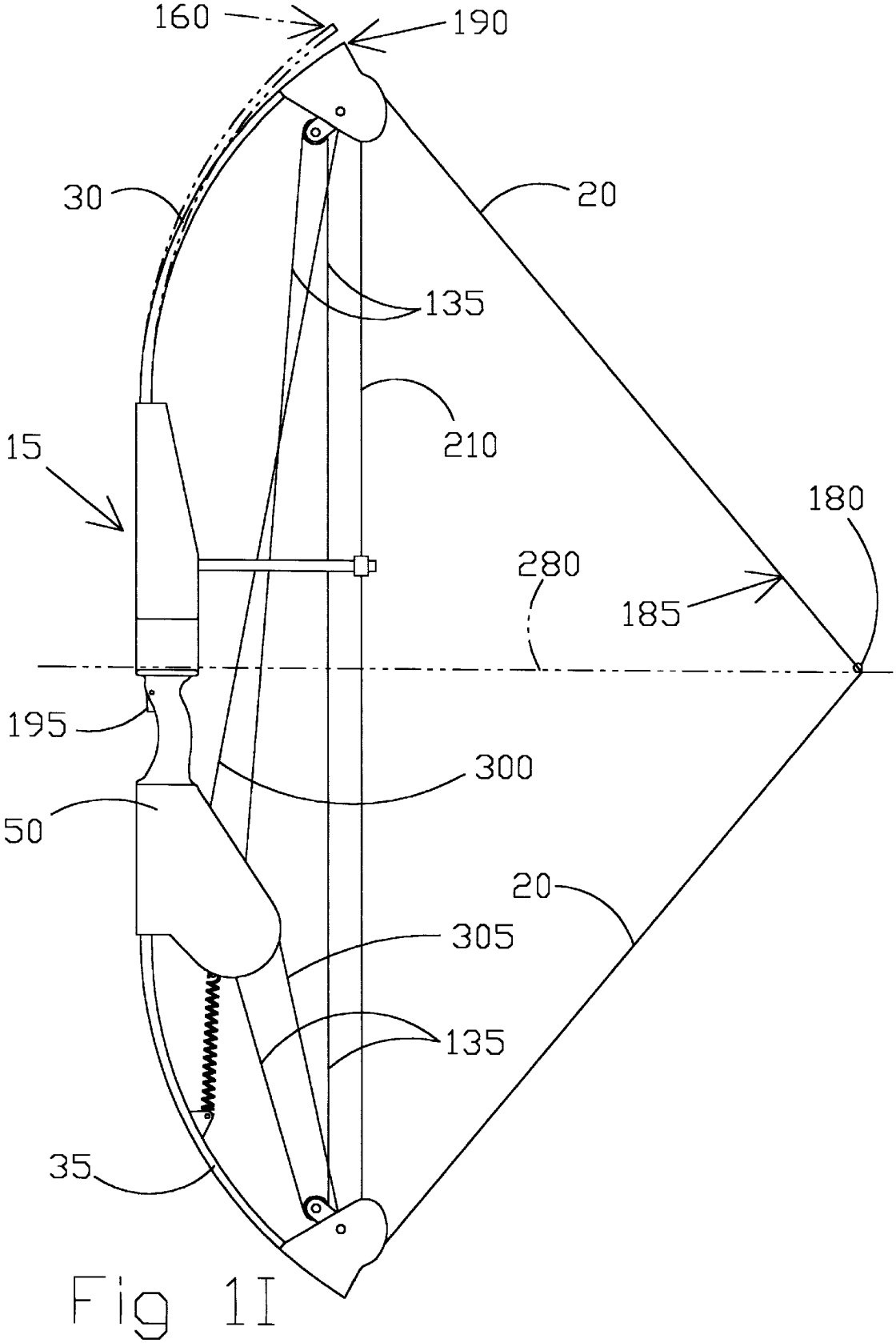
FIG. 1I is a plan view of the bow of this invention in a second full drawn position.

An arrow is then placed at a nocking point 180 of the draw string 20 and the draw string 20 is drawn back a second time to a second full drawn position 185 (FIG. 1I). The flexible limbs 30 & 35 are further deformed to a final or dynamic state of deformation 190. While holding the draw string 20 in the second full drawn position 185, a safety release 195 is activated allowing the deformation energy stored in the flexible limbs 30 & 35 from the first full draw to become available and combined with the deformation energy of the second full draw such that the deformation energy from each of the two full draws to be available to launch the arrow. The principles applied to the archery bow of the present invention are understood to apply to a plurality of full draws of the draw string. The deformation energy stored in the flexible limbs 30 & 35 and held by the block and tackle mechanism 145 is associated with the first full draw and each intermediate draw of the draw string 20. This stored and held deformation energy is then made available by the block and tackle mechanism to be combined with a deformation energy associated with a final full draw of the draw string 20 to launch the arrow.

An alignment rod 200 (FIG. 1A) attaches to the handle-riser 50 in one embodiment of the present invention and extends rearward 205 toward the archer and toward a linkage tie line 210. A cylindrically shaped alignment clip 215 fits over the alignment rod 200 and slides axially along the rod. The linkage tie line 210 attaches to the alignment clip 215 and also attaches to both the upper 85 and lower 120 pivoting linkages (FIGS. 1B& 1C) at upper 220 and lower 225 linkage tie sites, respectively. The linkage tie line 210 ensures that the distance from each linkage tie site 220 & 225 to the alignment clip 215 and the distance from the upper linkage tie site 220 to the lower linkage tie site 225 remain constant throughout each of the full drawn 150 & 185 and resting 25 &175 positions (as shown in FIGS. 1A–1E) involved in the plurality of full draws associated with the bow of this invention. As the draw string 20 is drawn during either the first 150 or second 185 full draw, the block and tackle mechanism 145 causes tackle line 135 to be taken up or wound upon a first 230 or second 235 cam pulley located within the block and tackle mechanism 145 and described in FIG. 3A resulting in a tackle line force on the upper 75 and lower 110 block pulleys acting toward the block and tackle mechanism 145. This force causes the upper 85 and lower 120 pivoting linkages to pivot about their pivoting linkage pivots 90 &125 maintaining a taught linkage tie line 210 and a constant distance between each linkage tie site 220 & 225 and the alignment clip 215 throughout each position in the bow drawing process.

The distance, d1 240 (FIG. 1B), from the block pulley axles 245 & 250 to the pivoting linkage pivot 90 & 125 provides the lever arm that is applied to the tackle line force within the tackle line 135 to create a torque acting to rotate the upper pivoting linkage 85 counterclockwise 255 and the lower pivoting linkage 120 clockwise 260. The distance, d2 265, from the idler pulley axle 270 & 275 to the pivoting linkage pivot 90 & 125 provides a lever arm that is applied to a draw string force acting toward a centerline 280 of the bow 15 to create a torque acting to rotate the upper pivoting linkage 85 clockwise 260 and the lower pivoting linkage counterclockwise 255. The distances, d1 240 and d2 265, are adjusted such that the counterclockwise 255 torque on the upper pivoting linkage 85 is greater and the linkage tie line 210 is therefore held under tension. The lower block pulley 110 and idler pulley 115 similarly expose the lower pivoting linkage 120 to a torque that tends to maintain the linkage tie line 210 under tension.

Maintaining a constant length in between the upper 220 and lower 225 linkage tie sites provides the draw string 20 with an approximately constant length loop while in either a resting position or in a full drawn position extending from the block and tackle mechanism 145 through the upper idler pulley 80, through the lower idler pulley 115 and back to the block and tackle mechanism 145. This allows each full draw of the draw string to provide approximately the same amount of draw length and provides draw energy for the full draw length of each full draw.

Attaching the linkage tie line 210 to the alignment clip 215 maintains the movement of the upper 80 and lower 115 idler pulleys in syncronization with each other maintaining a similar distance from each idler pulley 80 & 115 to the alignment clip 215 and provides the nocking point 180 of the draw string 20 with a movement parallel to the direction of arrow launch without subtle movements in a direction perpendicular to the line of arrow travel. These subtle movements can result due to small differences in flexibility characteristics between the upper 30 and lower 35 flexible limbs. The linkage tie line 210 could be attached directly to the alignment rod 200 without changing its purpose appreciably. The bow positions will be further described as the block and tackle mechanism 145 is described later in FIGS. 3–7. The position of the linkage tie site 220 & 225 along the length of the pivoting linkage 85 & 120 can be adjusted and optimized to allow each full draw of the draw string 20 to contribute a maximum amount of energy to be stored in the flexible bow limbs 30 & 35 such that the full draw length for each full draw is contributing draw energy for storage in the flexible limbs 30 & 35. The linkage tie sites 220 & 225 are also optimized to ensure that the nocking point 180 of the draw string 20 moves in a straight line by maintaining a constant length of draw string loop for each of the resting positions 25 & 175 or each of the full drawn positions 150 & 185 for the bow.

Figure 2A:
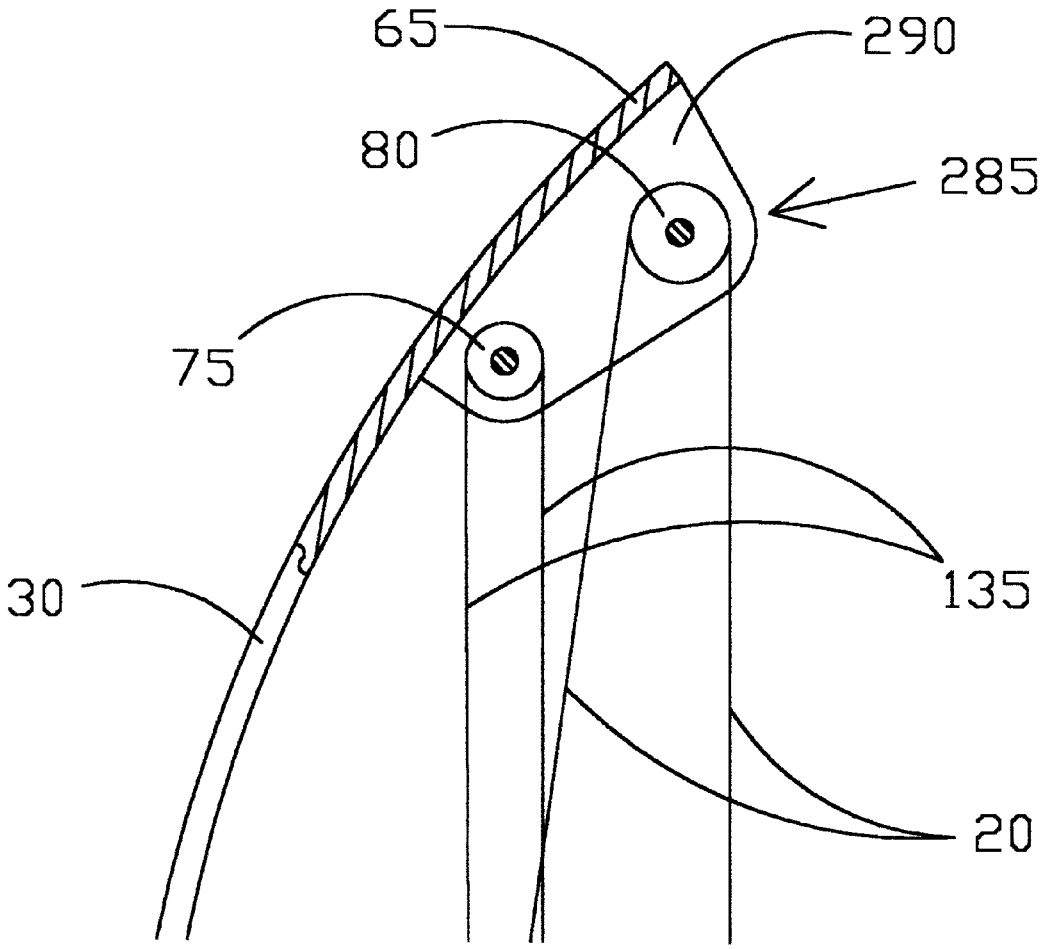
FIG. 2A is a partially sectioned view of an alternate upper pulley assembly.
Figure 2B:
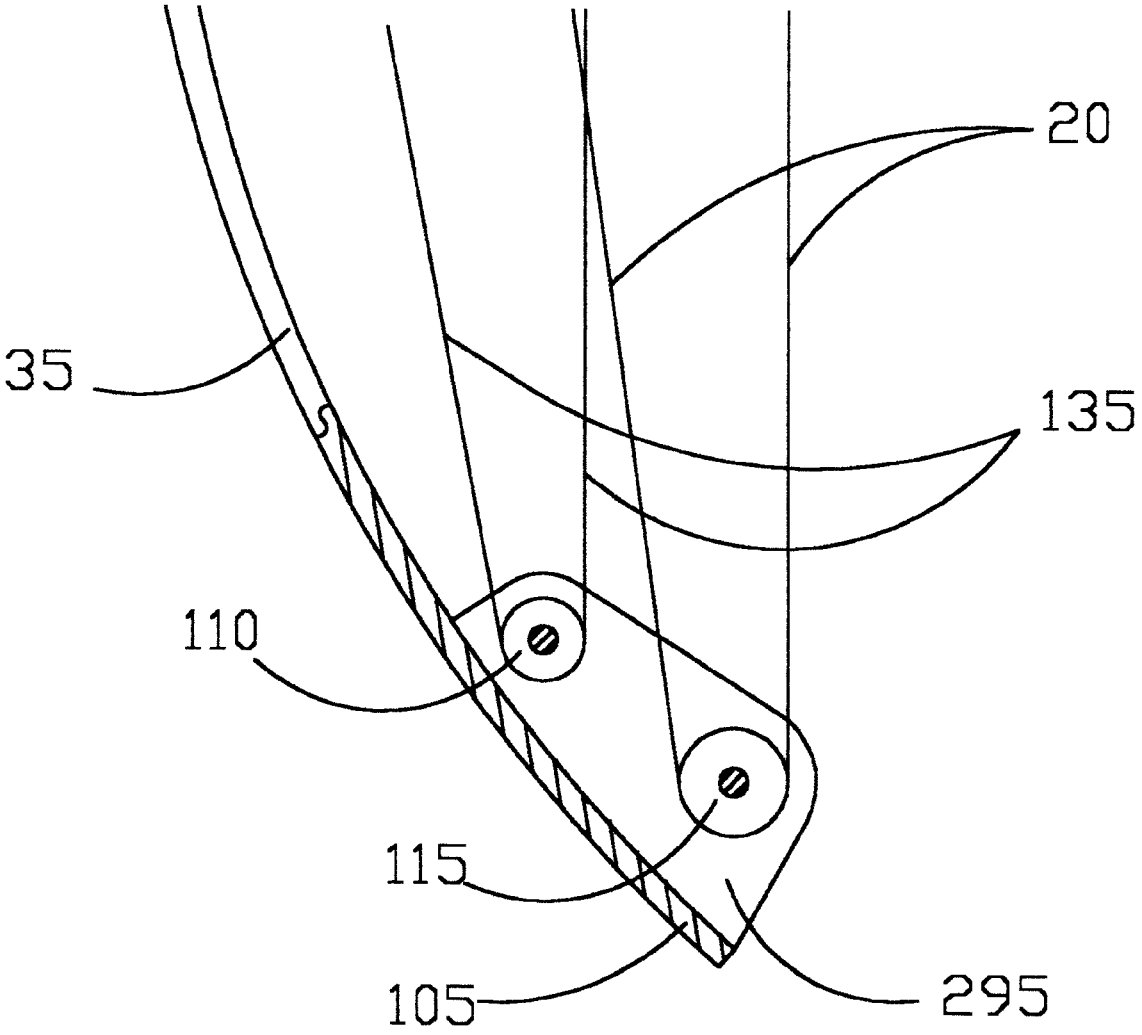
FIG. 2B is a partially sectioned view of an alternate lower pulley assembly.

FIGS. 2A & 2B show an alternative upper pulley assembly 285 component with, the upper idler 80 and block 75 pulley and the lower idler 115 and block 110 pulley attached to the free end of the upper 65 and lower 105 flexible limbs, respectively, without using a linkage. An upper limb fixed clevis 290 holds the upper block pulley 75 and the upper idler pulley 80 in a fixed position with respect to the flexible limb 30. The upper idler pulley 80 provides passage for the draw string 20 and the block pulley 75 provides passage for the tackle line 135. A lower limb fixed clevis 295 and pulleys 110 & 115 are similar to those on the upper limb fixed clevis 290. The upper and lower idler 80 & 115 and block 75 & 110 pulleys do not require the bow 15 to have a linkage tie line 210, an alignment rod 200, and an alignment clip 215 as shown in FIG. 1A. As shown in FIGS. 2A & 2B the draw string 20 is drawn back to the first full drawn position 150, the upper 290 and lower 295 limb fixed devises move in a rearward direction 205 towards the archer and closer to the centerline 280 of the bow. The flexible limbs 30 & 35 are held in an intermediate state of deformation 160 by the block and tackle mechanism 145 as the draw string 20 returns to the second resting position 175. The second full draw requires a reduced length of travel for the nocking point 180 of the draw string 20 to achieve a full drawn position 185. This is compensated for by the pivoting linkages 85 &120 shown in FIGS. 1*b* & 1*c* but not by the idler 80 & 115 and block 75 & 110 pulleys shown in FIGS. 2A & 2B. The result is that a more optimal amount of draw energy can be stored in the flexible limbs 30 & 35 for a plurality of draws with the block 75 & 110 and idler 80 & 115 pulleys shown in FIGS 1*a* &1*b* than with the block 75 & 110 and idler 80 & 115 pulleys shown in FIGS. 2A & 2B.

Figure 3A:
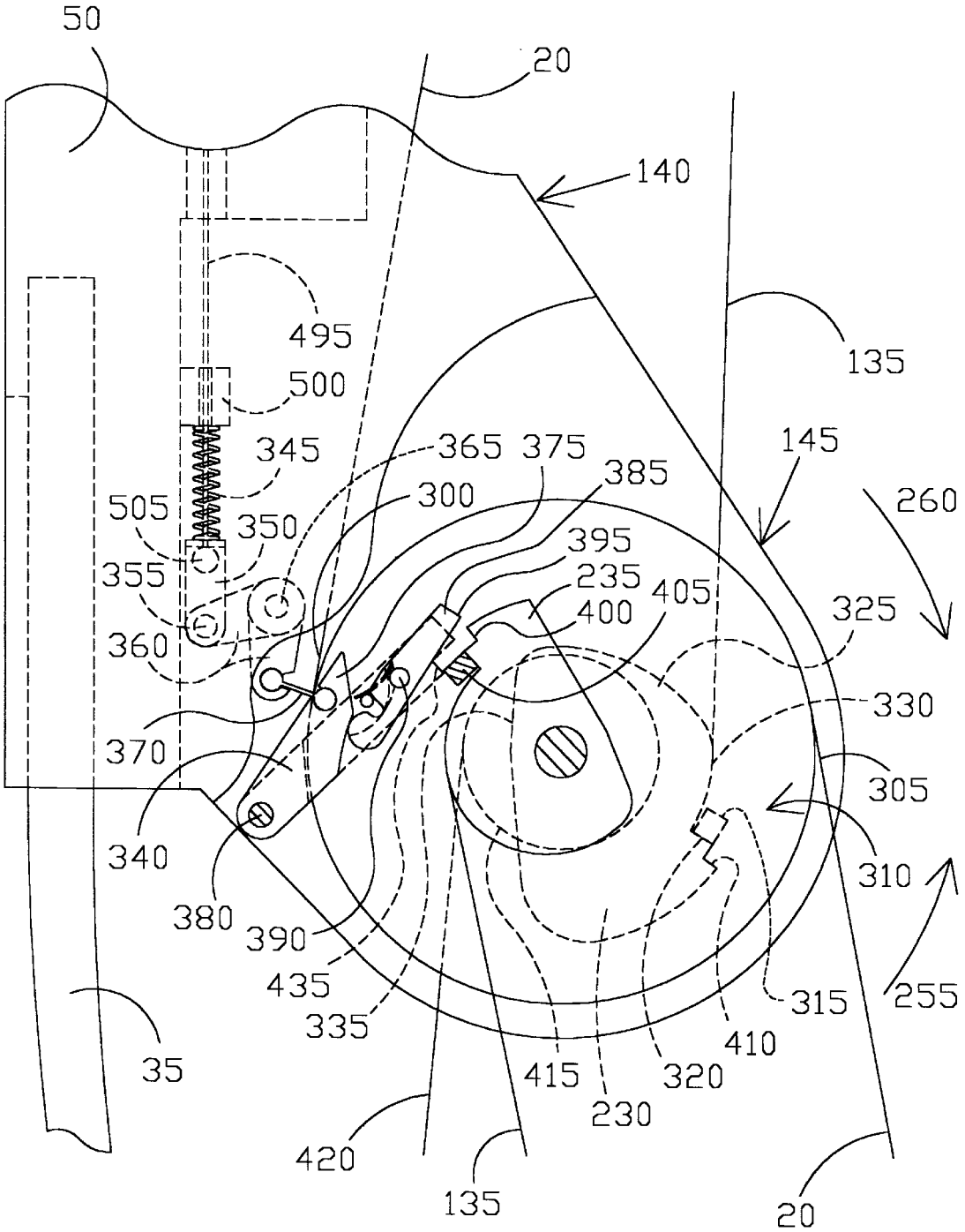
FIG. 3A is a partially sectioned view of the handle-riser and the block and tackle mechanism in a first resting position with the safety release not activated.

FIG. 3A shows a partially sectioned view of the handle-riser 50 with the block and tackle mechanism housing 140 attached to it and housing the block and tackle mechanism 145. The block and tackle mechanism 145 is a mechanical mechanism such as a differential windlass that allows draw energy from each draw of the draw string 20 to be stored as deformation energy in the flexible limbs 30 & 35 and made available to launch the arrow. As shown in FIG. 3A, the block and tackle mechanism 145 is in a position that is consistent with FIG. 1A where the flexible limbs 30 & 35 are in their initial or static state of deformation 155 and the draw string 20 is in its first resting position 25. As the draw string is drawn to a first full draw 150 (FIG. 1E), upper 300 and lower 305 draw string ends which are attached to a draw pulley mechanism 310, cause the draw pulley mechanism 310 to rotate in a clockwise 260 direction and draw string 20 is being payed out. An index stop 315 which is attached to the draw pulley mechanism 310 pushes against a first cam tab 320 of a first cam pulley 230 causing it to also rotate clockwise 260 taking up tackle line 135 as it winds the tackle line 135 around a perimeter 325 of the first cam pulley from a point of attachment at an upper tackle line attachment site 330 to a first cam configured let-off 335 which provides a let-off of force to the draw string 20 at the end of the first full draw.

The take-up of tackle line 135 by the first cam pulley 230 exerts a force on the upper 75 and lower 110 block pulleys (FIG. 1E) causing them to move closer together and causing the flexible limbs 30 & 35 to become deformed to an intermediate state of deformation 160 as shown in FIG. 1E. The first cam pulley 230 could also be a variable radius pulley with an outer perimeter composed of a surface with several radii of curvatures or an eccentric circular pulley with an axis that is not axisymmetric.

A first cam latch 340 is held in the initial position shown in FIG. 3A by a force exerted by a first cam latch spring 345 which pushes against a second clevis 350 which transfers force to a second clevis pivot 355 causing a bell crank 360 to pivot upon a bell crank pivot 365 and pushing against a first cam latch linkage 370 which pushes against a first cam latch extension 375 that is rigidly attached to the first cam latch 340 which is able to pivot upon a first cam latch pivot 380.

During the first full draw, the first cam latch extension 375 interfaces with a positional latch 385 as shown in FIG. 3A which is attached to the draw pulley mechanism causing it to pivot about a positional latch pivot 390 and allowing a positional latch head 395 to miss a second cam recess 400 as the draw pulley mechanism 310 rotates clockwise 260. A positional stop 405 attached to the block and tackle mechanism housing 140 holds the second cam pulley 235 in position during the first full draw.

Figure 3B:
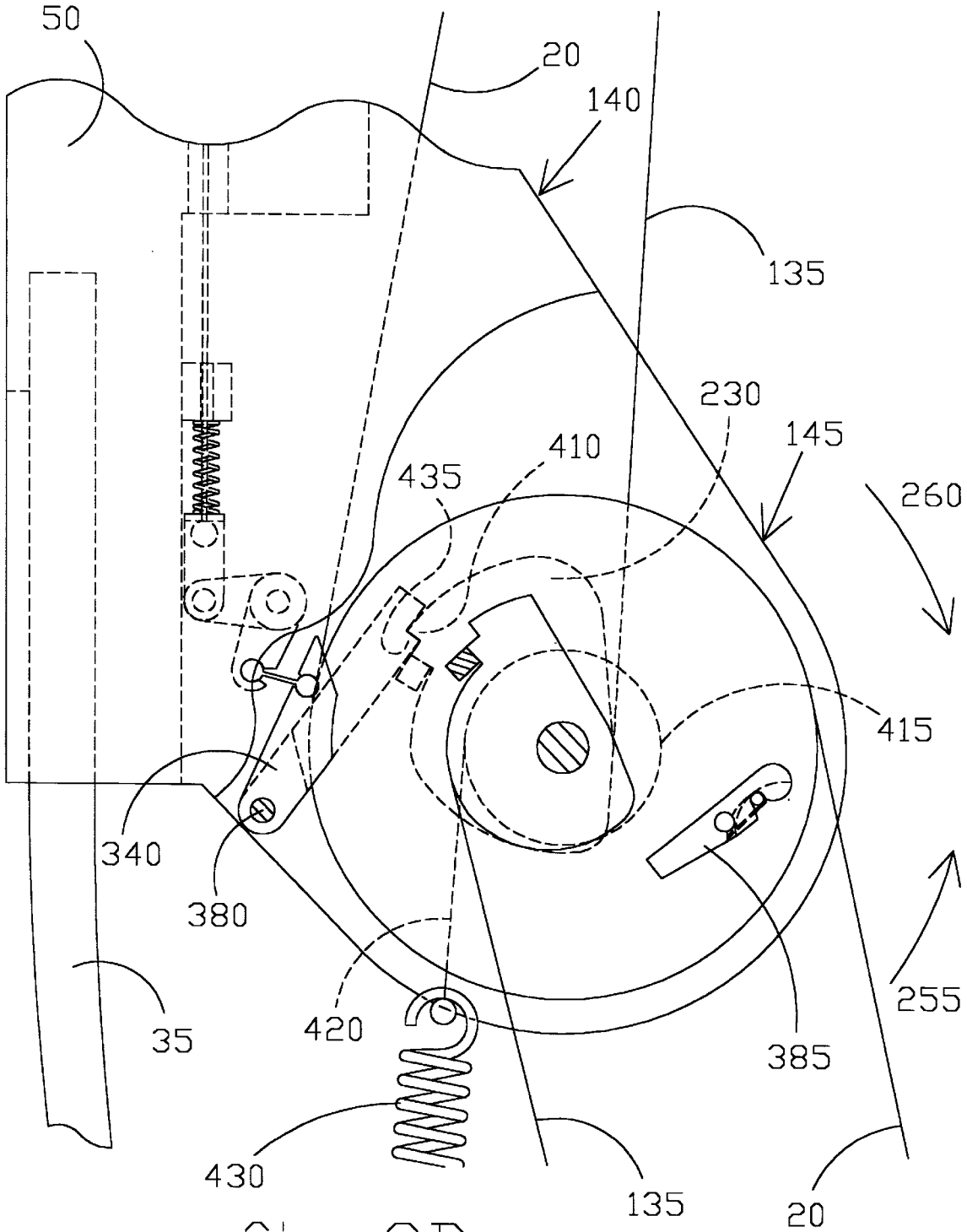
FIG. 3B is a partially sectioned view of the block and tackle mechanism in a first full drawn position.

With the bow in the first full drawn position 150 as shown in FIG. 3B, the first cam latch 340 has been rotated on the first cam latch pivot 380 allowing a first cam recess 410 to engage with the first cam latch 340 preventing the first cam pulley 230 from rotation counterclockwise 255 and holding the bow 15 in an intermediate state of deformation 160.

Figure 3C:
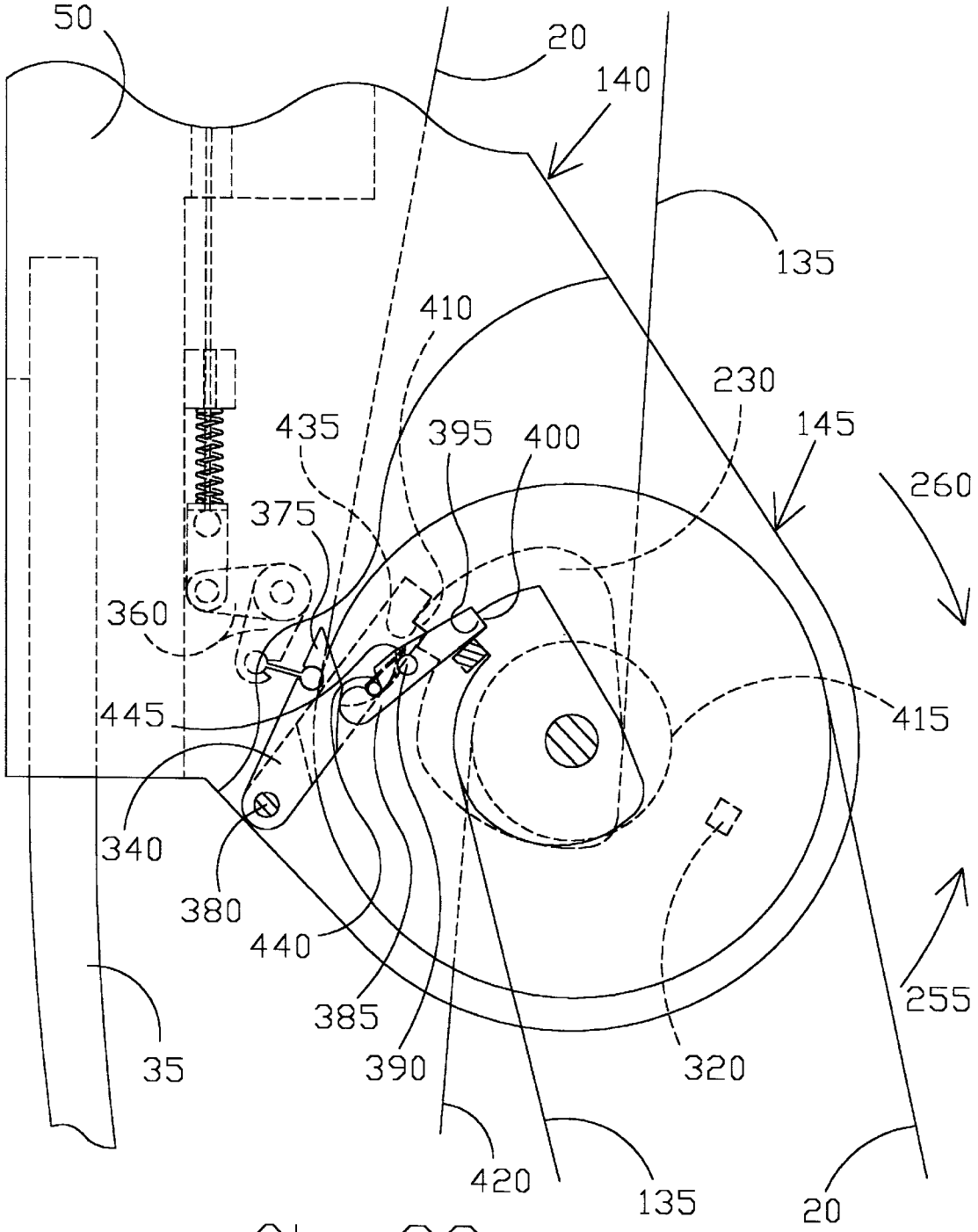
FIG. 3C is a partially sectioned view of the block and tackle mechanism in a second resting position.

A draw string return pulley 415 attached to the draw pulley mechanism 310 causes counterclockwise 255 rotation to take up draw string 20 as the draw string 20 returns to the second resting position 175 after the first full draw as shown in FIG. 3C. A draw string return line 420 attaches to the draw string return pulley 415 at a return line attachment site 425 and attaches to a draw string return spring 430. The draw string return spring 430 as shown in FIG. 1A is attached to the lower flexible limb 35 of the bow. The draw string return spring 430 is not required to be a coil spring nor is it required to attach to the lower flexible limb 35 as shown in FIG. 1A. The return spring 430 could be a clock spring, other spring means, or the flexible limbs used either directly or indirectly to rotate the draw pulley mechanism 310 and bring the draw string 20 into its second resting position 175 as shown in FIG. 11; it could attach to the handle-riser 50 or other bow component capable of supporting a spring means.

Figure 3D:
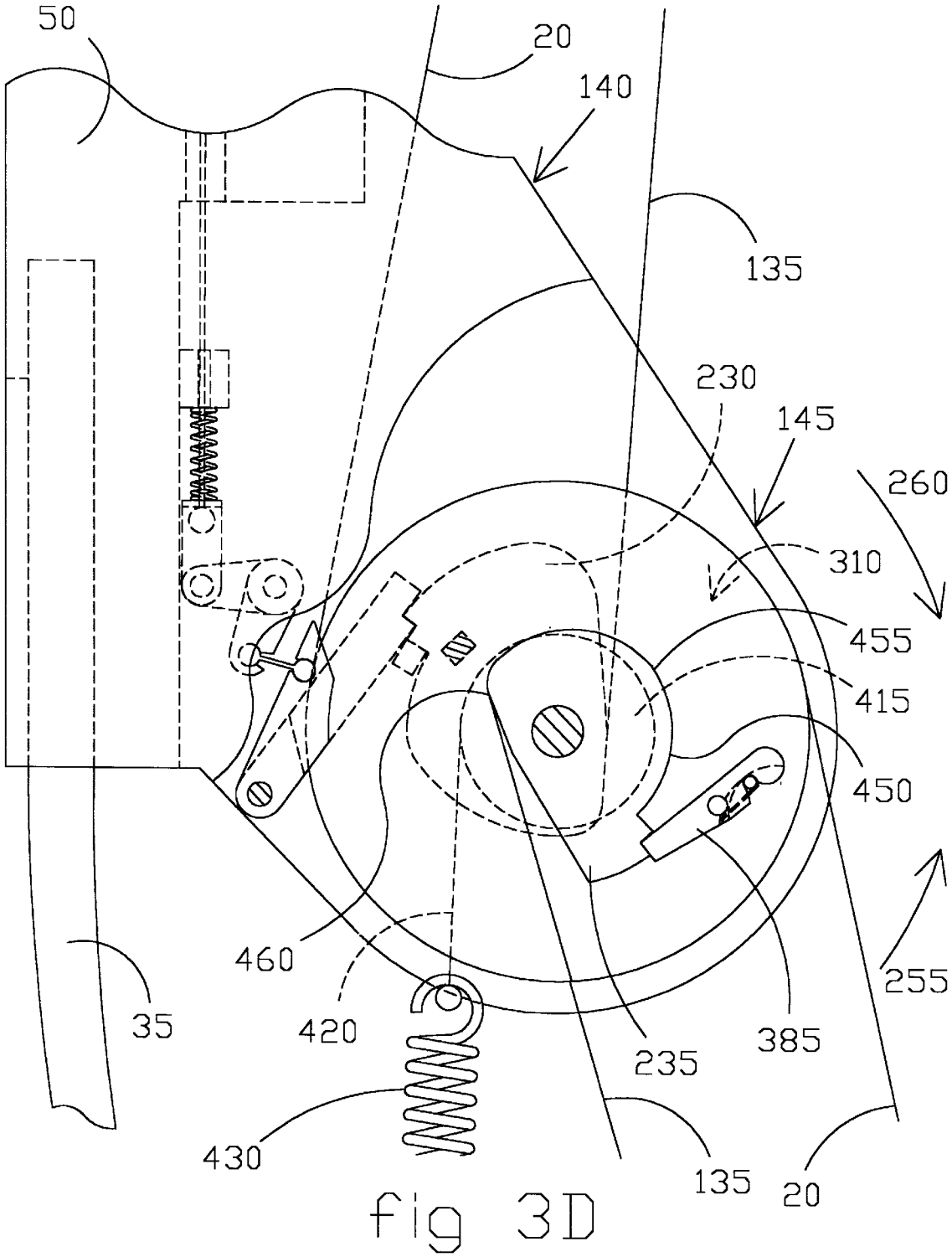
FIG. 3D is a partially sectioned view of the block and tackle mechanism in a second full drawn position

With the bow in the second resting position as shown in FIG. 3C the first cam latch recess 435 has engaged the first cam recess 410 and has repositioned the first cam latch extension 375 toward the bell crank 360 allowing the positional latch 385 to pivot about the positional latch pivot 390 under the force of a leaf spring 440 attached to the positional latch at a leaf spring attachment site 445 and engage the positional latch head 395 into the second cam recess 400. Other latching means comprising a movable latching bar connected to a spring could be employed to hold the first cam pulley 230 in position following the first full draw of the draw string 20. During the second draw of the draw string 20, as shown in FIG. 3D, the draw pulley mechanism 310 again rotates clockwise 260 as the positional latch 385 which is attached to the draw pulley mechanism 310 causes the second cam pulley 235 to rotate clockwise 260. The tackle line 135 is attached to the second cam pulley 235 at the lower tackle line attachment site 450 and is taken up by a perimeter 455 of the second cam pulley 235 reaching a second cam configured let-off 460 which provides a reduction in draw force at the end of the second full draw. The second cam pulley 235 could be a variable radius pulley or an eccentric pulley. The first 230 and second 235 cam pulleys are configured to provide a similar draw force for each of the plurality of full draws. The take-up of tackle line 135 by the second cam pulley 235 exerts a force on the upper 75 and lower 110 block pulleys causing them to move closer together and causing the flexible limbs 30 & 35 to become deformed to a final or dynamic state of deformation 465 as shown in FIG. 1E. The first 230 and second 235 cam pulleys together can be considered as tackle pulley means. The tackle pulley means attaches to the tackle line 135 and latches to the draw pulley mechanism 310 providing let-off of draw force for each draw of the draw string.

The index stop 315 (FIG. 3E) which is attached to the draw pulley mechanism 310 contacts the first cam tab 320 at the end of the second full draw allowing the first cam latch recess 435 to lose immediate contact with the first cam recess, making it possible to activate the safety release 195 and disengage the first cam latch 340 from the first cam recess 410. Disengagement of the first cam latch 340 allows the deformation energy stored in both the upper 30 and lower 35 flexible limbs to be available through the tackle line 135 to rotate the first cam pulley 230 counterclockwise 255 pushing the index stop 315 counterclockwise 255 and turning the draw pulley mechanism 310 counterclockwise 255 to take up the draw string 20 and launch the arrow. The deformation energy stored in the flexible limbs 30 & 35 also is available through the tackle line 135 to rotate the second cam pulley 235 counterclockwise 255 pushing the positional latch 385 counterclockwise 255 and turning the draw pulley mechanism 310 counterclockwise 255 to take up the draw string 20 and launch the arrow.

Figure 3E:
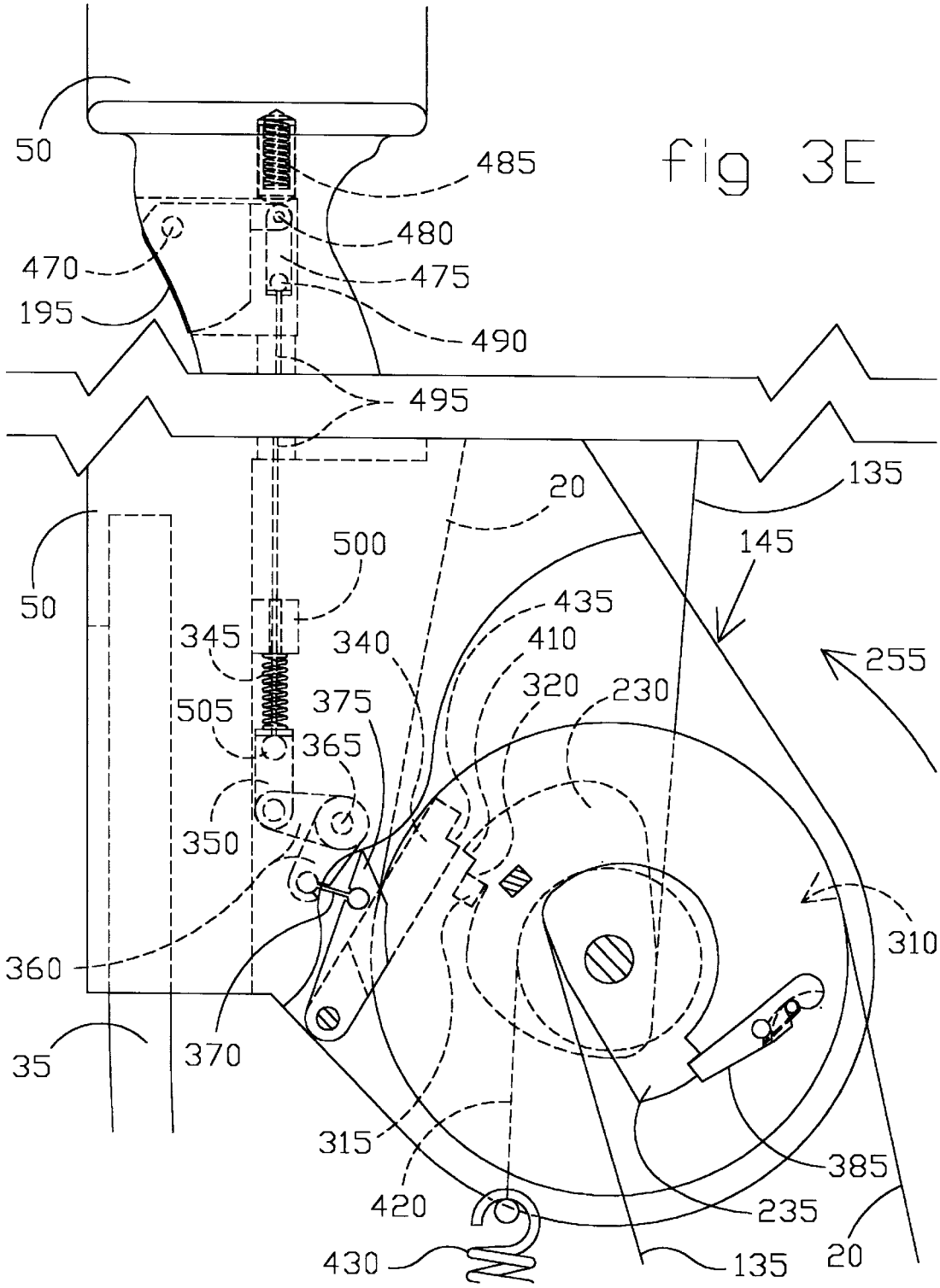
FIG. 3E is a partially sectioned view of the handle-riser and the block and tackle mechanism in a second full drawn position with the safety release activated.

To disengage the first cam latch 340 at the end of the second full draw the archer digitally depresses the safety release 195 found on the handle-riser 50 causing it to pivot about a safety release pivot 470 driving a first clevis 475 upward as it pivots about a first clevis pivot 480 and compresses a safety release return spring 485. The first clevis 475 pulls against a first end 490 of a connecting line 495. The connecting line 495 could be a rod or cable or other means to connect the safety release 195 with the first cam latch 340. As shown in FIG. 3A and 3E, the connecting line 495 passes through a spring block 500, through the first cam latch spring 345 and a second end 505 of the connecting line 495 is attached to the second clevis 350 which pivotally joins to the bell crank 360. Upward movement of the first clevis 475 causes upward movement of the second clevis 350 causing the bell crank 360 to rotate about its pivot 365 and causing the first cam latch linkage 370 to pull the first cam latch extension 375 and first cam latch 340 in a direction to disengage the first cam latch 340 from the first cam recess 410 of the first cam pulley 230.

Once the first cam latch 340 has been disengaged at the end of the second full draw, the archer can release the draw string 20 and deliver the deformation energy stored in both flexible limbs 30 & 35 through the tackle line 135 to the block and tackle mechanism 145 and from the block and tackle mechanism 145 to the draw string 20 to launch the arrow with a kinetic energy equal to the total energy stored as deformation energy of the flexible limbs 30 & 35 from each of the full draws of the draw string 20. If the archer does not wish to launch the arrow following the second full draw, the archer can release the safety release 195 allowing the first cam latch 340 to engage with the first cam recess 415. The draw string 20 can be returned to the second resting position 175 at an intermediate force similar to the force required to draw the draw string 20 to the second full draw 185.

The draw string forms a loop that travels from the draw pulley mechanism 310 through the upper idler pulley 80, through the lower idler pulley 115 and back to the draw pulley mechanism 310. The length of this loop remains approximately constant due to the pivotable linkage, whether the bow 15 is in the first resting position 25 or the second resting position 175. The loop has a different, although approximately constant, length when the bow 15 is in the first full drawn position 150 or the second full drawn position 185. The length of draw for the first full draw from the first resting position to the first full drawn position is therefore approximately the same as the length of draw for the second full draw. This approximate equality in each draw length allows the bow 15 of this invention to extract draw energy for the entire draw length for each of the plurality of draws of the draw string. The bow 15 can therefore more efficiently provide a greater draw energy at a lower average draw force for a plurality of draws; greater amounts of deformation energy of the flexible limbs can be stored using a lower average draw force for a specific number of draws of the draw string. The linkage tie line 210 insures that the loop remains a constant length under the condition that variations in flexibility between the upper 30 and lower 35 flexible limbs exist. Attachment of the linkage tie line 210 to the alignment rod 200 adds the additional benefit that the nocking point 180 of the draw string 20 must move in a straight line in the direction of arrow launch.

The perimetric length of the draw string from the nocking point 180, over the upper idler pulley 80, to the draw pulley mechanism 310 is maintained such that it is approximately equal to the parimetric length from the nocking point 180, over the lower idler pulley 115, to the draw pulley mechanism 310. The distance between each idler pulley and the centerline 280 of the bow 15 is required to be approximately equal due to the attachment of the linkage tie line to the alignment rod. As the draw pulley mechanism 310 rotates during each full draw of the draw string 20, the draw string is payed out equally over the upper idler pulley 80 and over the lower idler pulley 115. Maintaining each idler pulley at a fixed distance from the centerline of the bow then allows the pay-out of draw string to the nocking point 180 to be equal and allows the nocking point 180 to move in a direction parallel with the centerline 280 of the bow 15. The movement of the nocking point 180 during arrow launch is therefore also parallel to the centerline 280 resulting in a straight, accurate arrow launch.

The bow 15 of the present invention has been presented as requiring full draws of the draw string. This is not a requirement placed upon the bow 15 by virtue of the design but rather has been presented due to the efficiency associated with extracting the maximum amount of stored deformation energy with the minimum number of draws of the draw string 20. Any one or all or the draws of the draw string could have been drawn to a fraction of the full drawn position if desired. The first draw, for example, could be drawn to a fraction of the first full drawn position 150 by adjusting the perimeter 325 of the first cam pulley 230. Similarly, any of the plurality of draws can be adjusted such that the draw length has been reduced.

Figure 4:
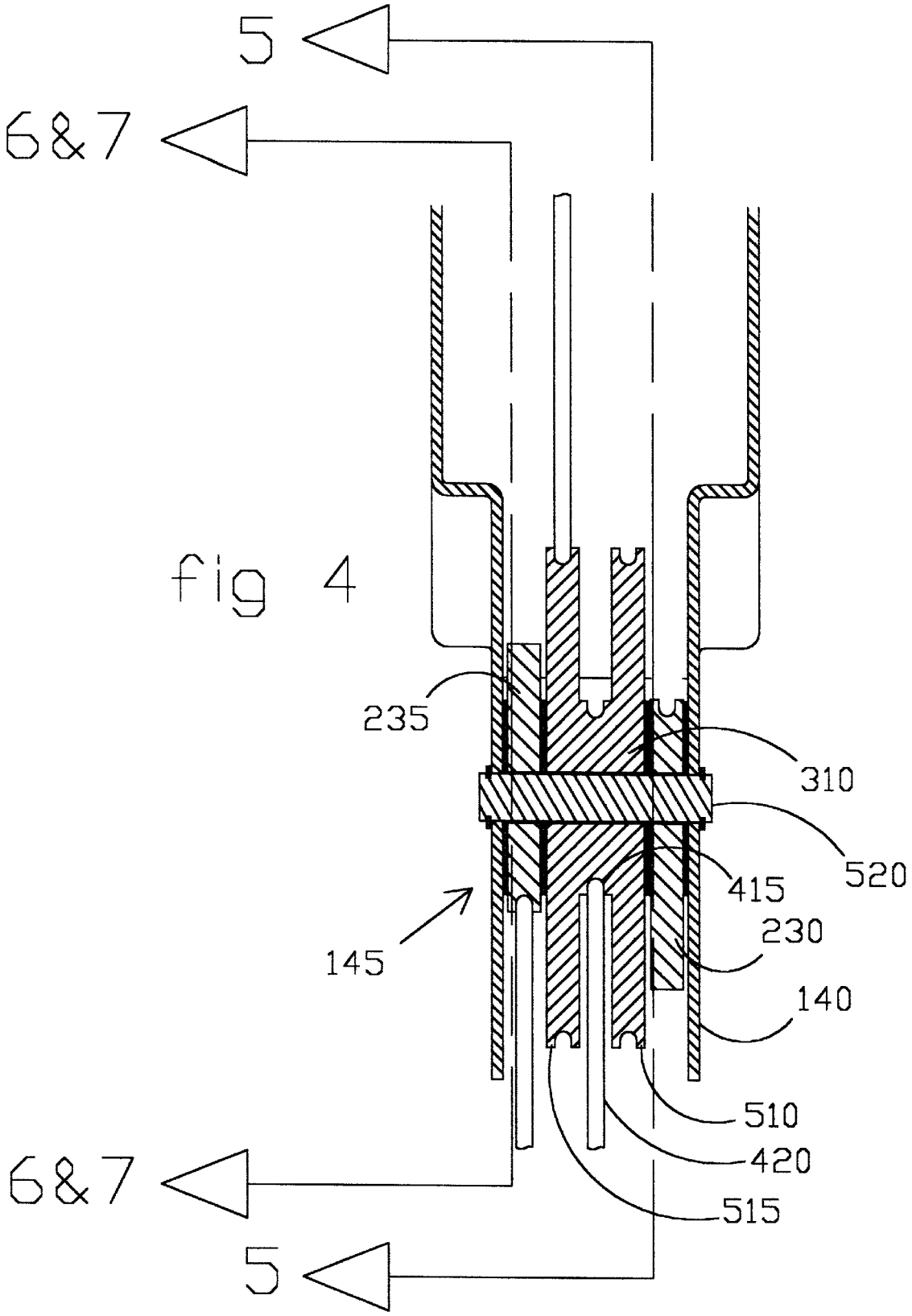
FIG. 4 is a sectioned view of the block and tackle mechanism in a first resting position.

FIG. 4 shows a sectioned view of the block and tackle mechanism 145 and the block and tackle mechanism housing 140 as shown in FIG. 1A with the draw string 20 in the first resting position 25. The draw pulley mechanism 310 includes two draw pulleys 510 & 515, a first draw pulley 510 and a second draw pulley 515. The upper draw string end 300 is attached to the first draw pulley 510 and the lower draw string end 305 is attached to the second draw pulley 515. The first 510 and second 515 draw pulleys are shown as two separate round axisymmetric pulleys and are rotationally attached to each other. It is within the scope of the present invention that these draw pulleys which take up and pay out draw string can be variable radius pulleys, eccentric pulleys, or cam pulleys in order to achieve a different or more favorable force-draw curve during the draw of the draw string. A more favorable force-draw curve could provide a smoother or more accurate launch of the arrow, provide a more efficient or a greater storage of draw energy, or achieve altered let-off of draw force characteristics. Furthermore a more favorable force-draw curve could provide the archer with a more evenly distributed low draw force over much of the draw length or provide a more smooth transition of draw force as the archer enters and leaves the let-off position. A single draw pulley could also be used within the scope of the present invention for take up and pay out of the draw string. A main axle 520 shown in FIG. 4 provides the rotational axis for the first cam pulley 230, the second cam pulley 235, the draw pulley mechanism 310, and the draw string return pulley 415.

The perimeter of the first cam pulley 325 (FIG. 3A) along with its variable distance from the main axle 520 determine the magnitude of the draw force associated with the first full draw of the draw string 20. The perimeter of the second cam pulley 455 (FIG. 3C) along with its variable distance from the main axle 520 determines the magnitude of the draw force associated with the second full draw of the draw string 20. The greater the perimetric distance from the main axle 520, the greater will be the draw force for a particular draw of the draw string 20. The perimeters of the first and second cam pulleys 325 & 455 can be adjusted such that the first full draw has a similar draw force to the second full draw, or the draw force can be greater or lesser for the first or second draw. It may be advantageous to provide a lower average draw force for the second draw allowing the archer to generate the second full draw with the arrow attached to the nocking point 180 at a more comfortable, lower average draw force.

The first draw pulley 510 and the second draw pulley 515 can also be adjusted in their relative diameter or adjusted such that they are not axisymmetric to alter the draw force required to draw the draw string during a first draw relative to a second draw. An increase in diameter for the first draw pulley 510 will result in a greater required draw force for the first full draw. These principles presented for adjusting the draw force by adjusting the diameter or perimetric shape of the cam pulleys 325 & 455 or the draw pulleys 510 & 515 can be applied equally well to a multiple draw bow requiring more than two draws of the draw string 20.

Figure 5A:
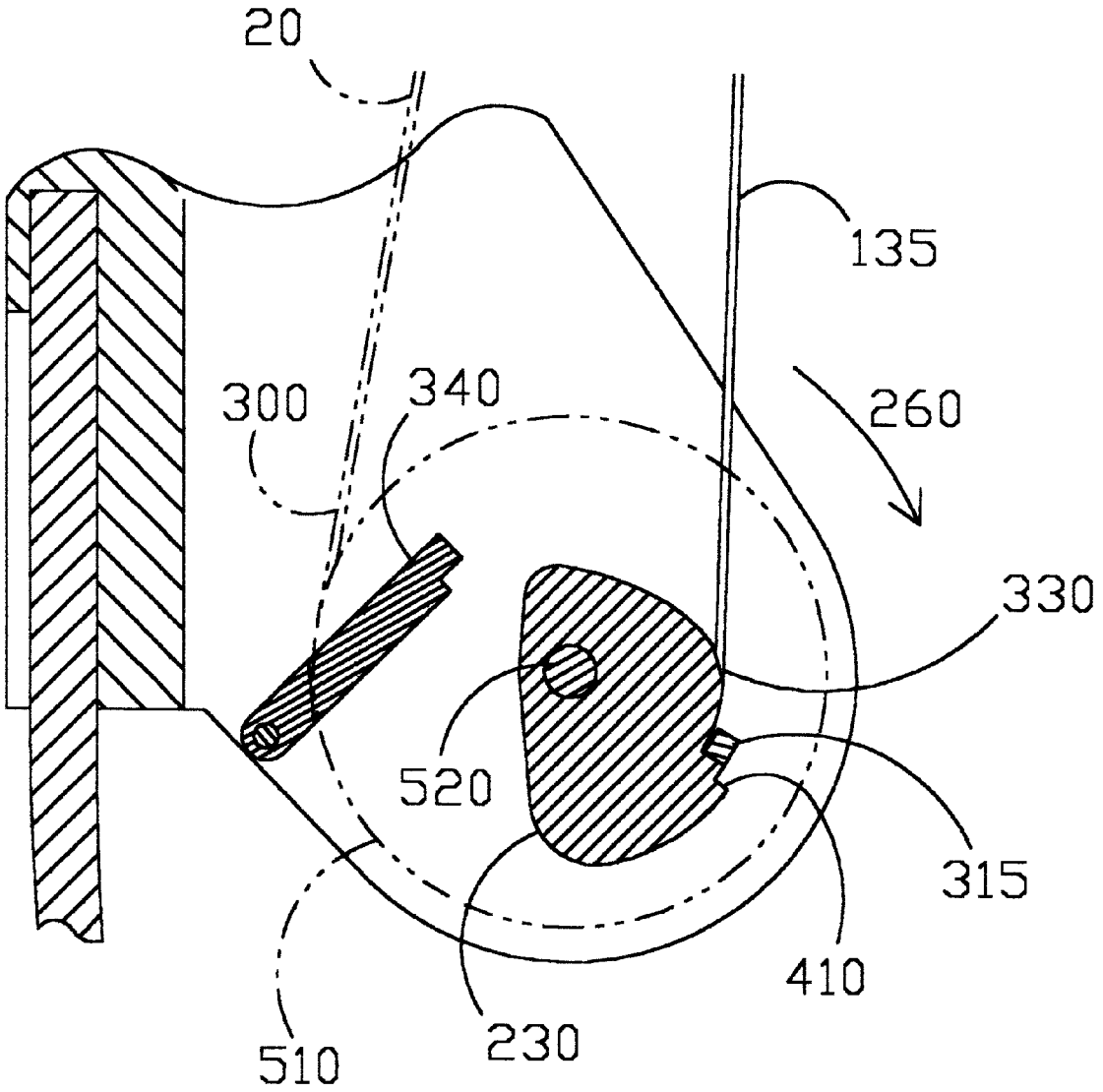
FIG. 5A is a sectioned view of the first cam pulley in a first resting position.
Figure 5B:
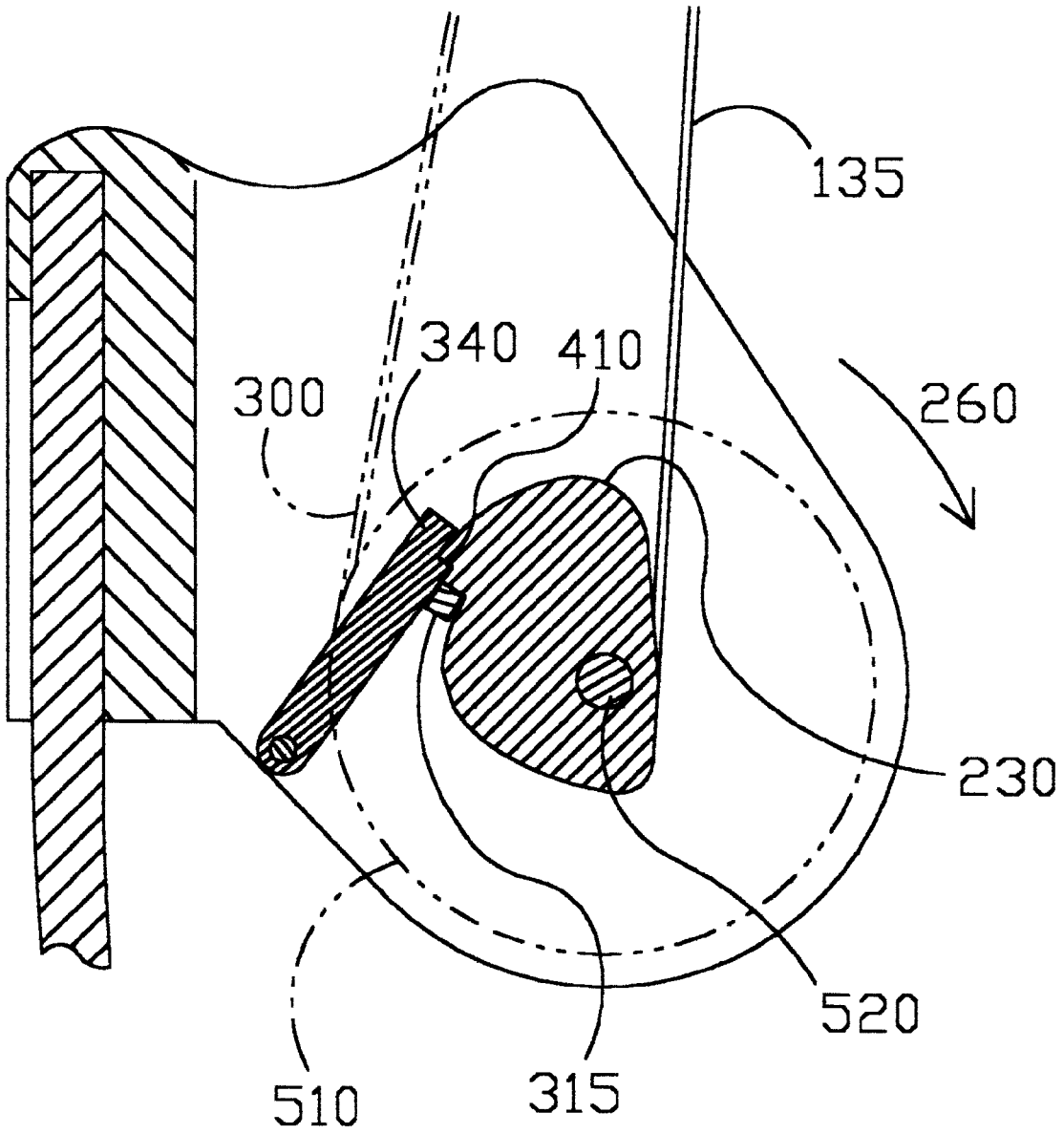
FIG. 5B is a sectioned view of the first cam pulley in a first full drawn position.

FIGS. 5A & 5B show a sectioned view taken from FIG. 4 with the bow in its first resting position 25. The upper draw string end 300 is attached to the first draw pulley 510. As the draw string 20 is drawn to a first full draw 150, the first draw pulley 510 which is attached to the index stop 315 rotates clockwise 260 causing the first cam pulley 230 to rotate clockwise about the main axle 520. The tackle line 135 which is attached at its upper tackle line end 330 to the first cam pulley 230 is taken up by the first cam pulley 230 until the first cam recess 410 has engaged the first cam latch 340 (FIG. 5B) at the end of the first full draw.

Figure 6A:
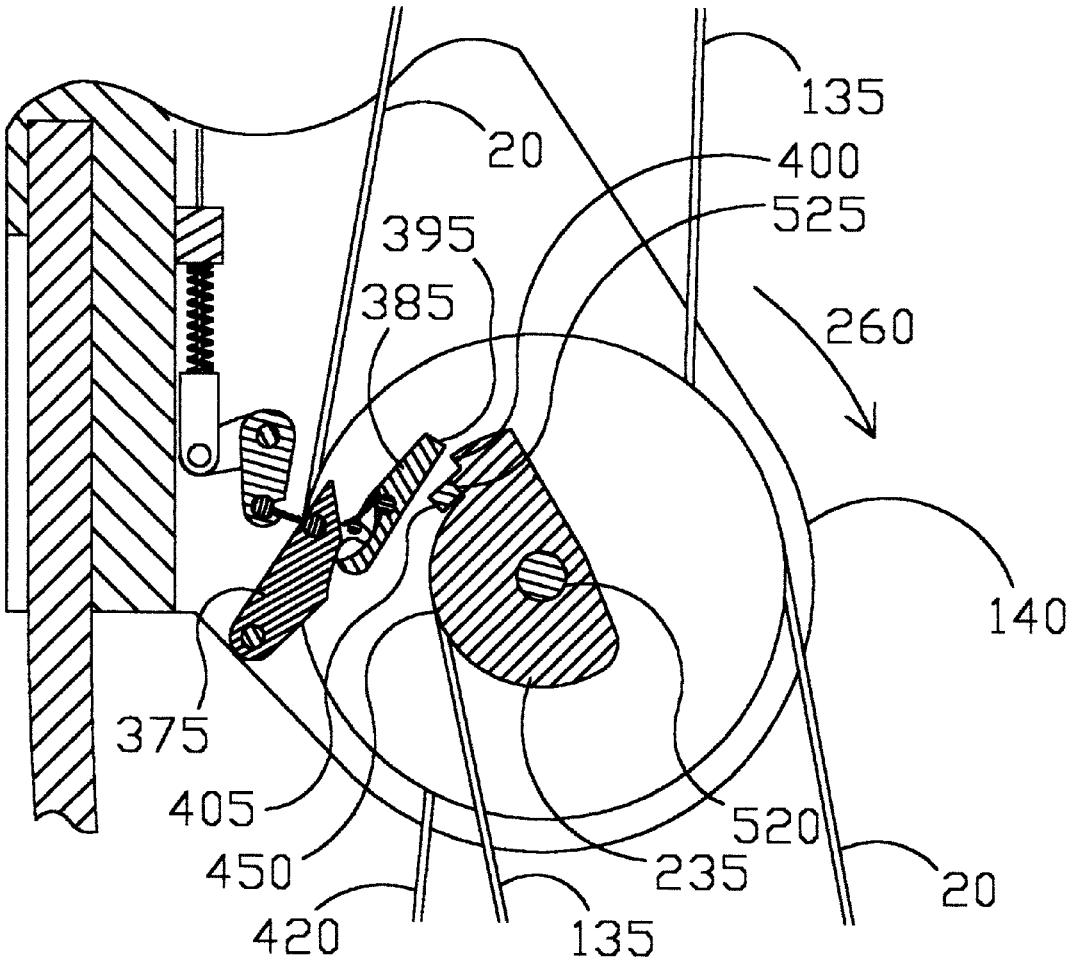
FIG. 6A is a sectioned view of the second cam pulley in a first resting position.
Figure 6B:
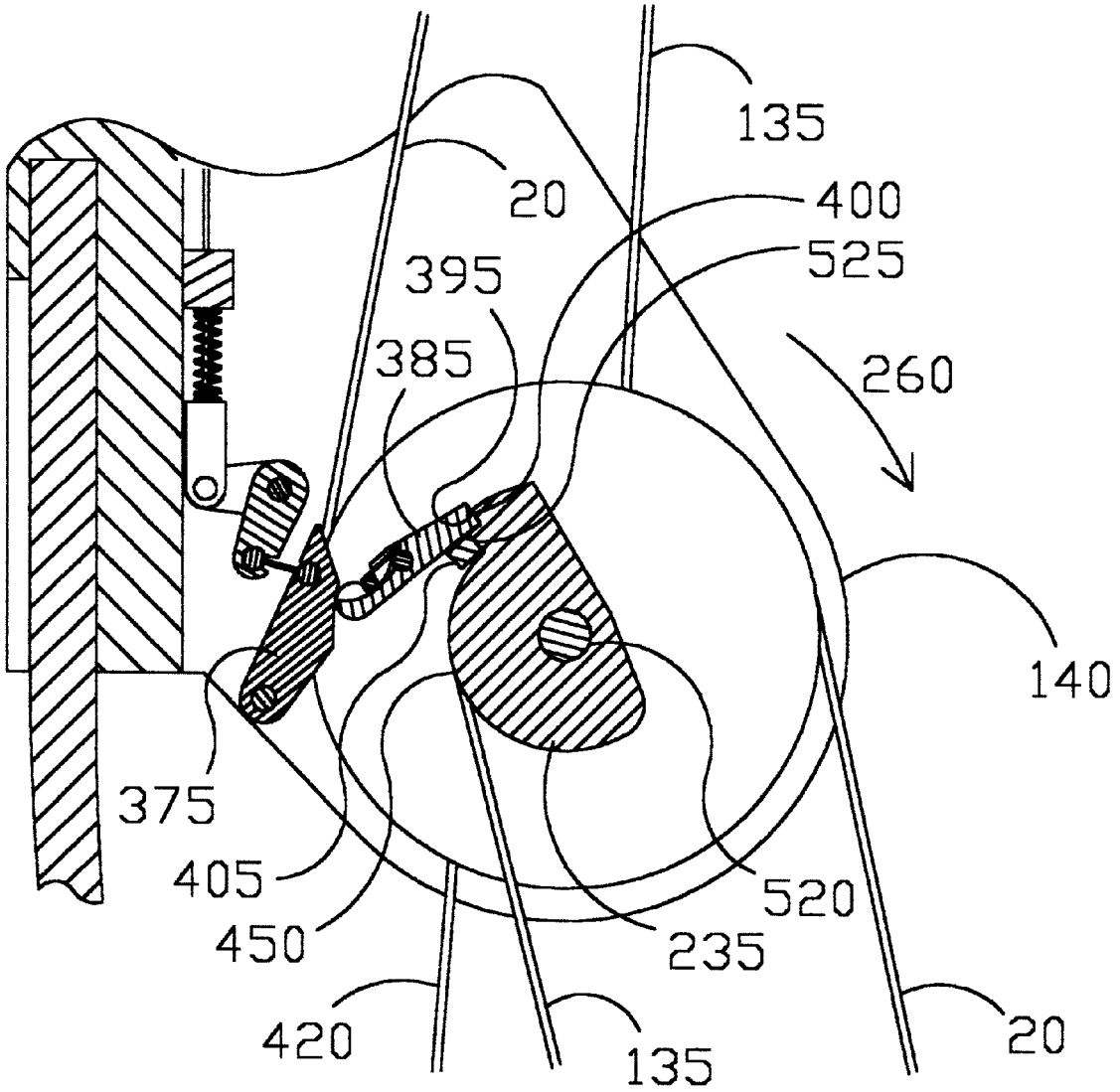
FIG. 6B is a sectioned view of the second cam pulley in the second full drawn position.

FIG. 6A shows a sectioned view taken through the second cam pulley 235 with the bow 15 in the first resting position 25. All the components are described by like reference numerals used in FIG. 3A–3E. During the first draw of the draw string 20, the positional stop 405 which is attached to the block and tackle mechanism housing holds the second cam pulley 235 in the position shown in FIG. 6A. During the second full draw (FIG. 6B), the head 395 of the positional latch 385 latches with the second cam recess 400 and rotates the second cam pulley 235 clockwise 260 until the tackle line 135 is positioned in the second cam configured let-off 460 position (FIG. 6C) of the second cam pulley 235. As the archer activates the safety release 195 and releases the draw string, the tackle line 135 pulls the second cam pulley 235 in a counterclockwise 255 direction which pushes the positional latch 385 in a counterclockwise 255 direction until the second cam tab 525 strikes the positional stop 405 and the draw string 20 is returned to its first rest position 25 as shown in FIG. 6A.

Figure 6C:
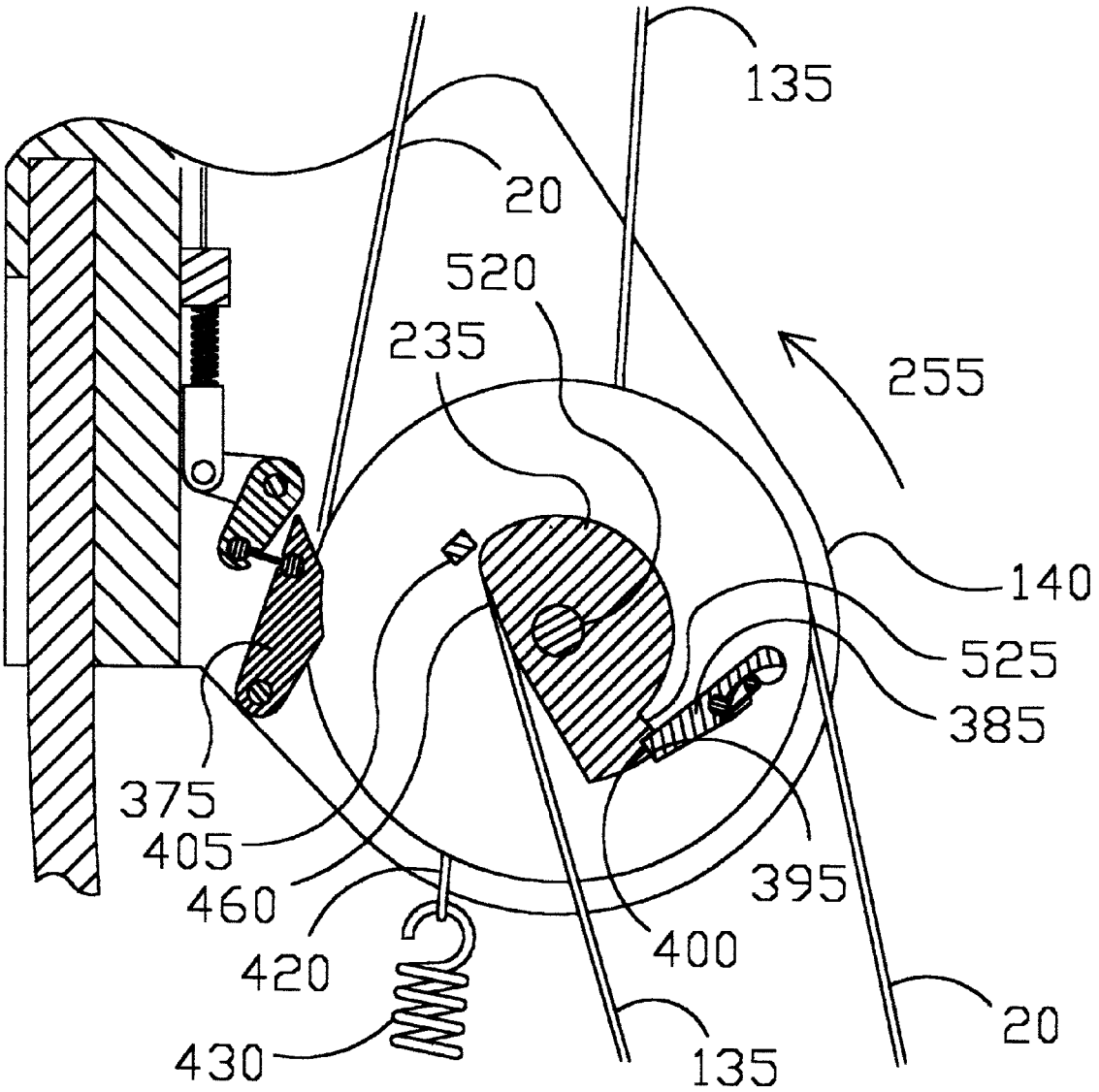
FIG. 6C is a sectioned view of the second cam pulley in the second cam configured let-off position.
Figure 7A:
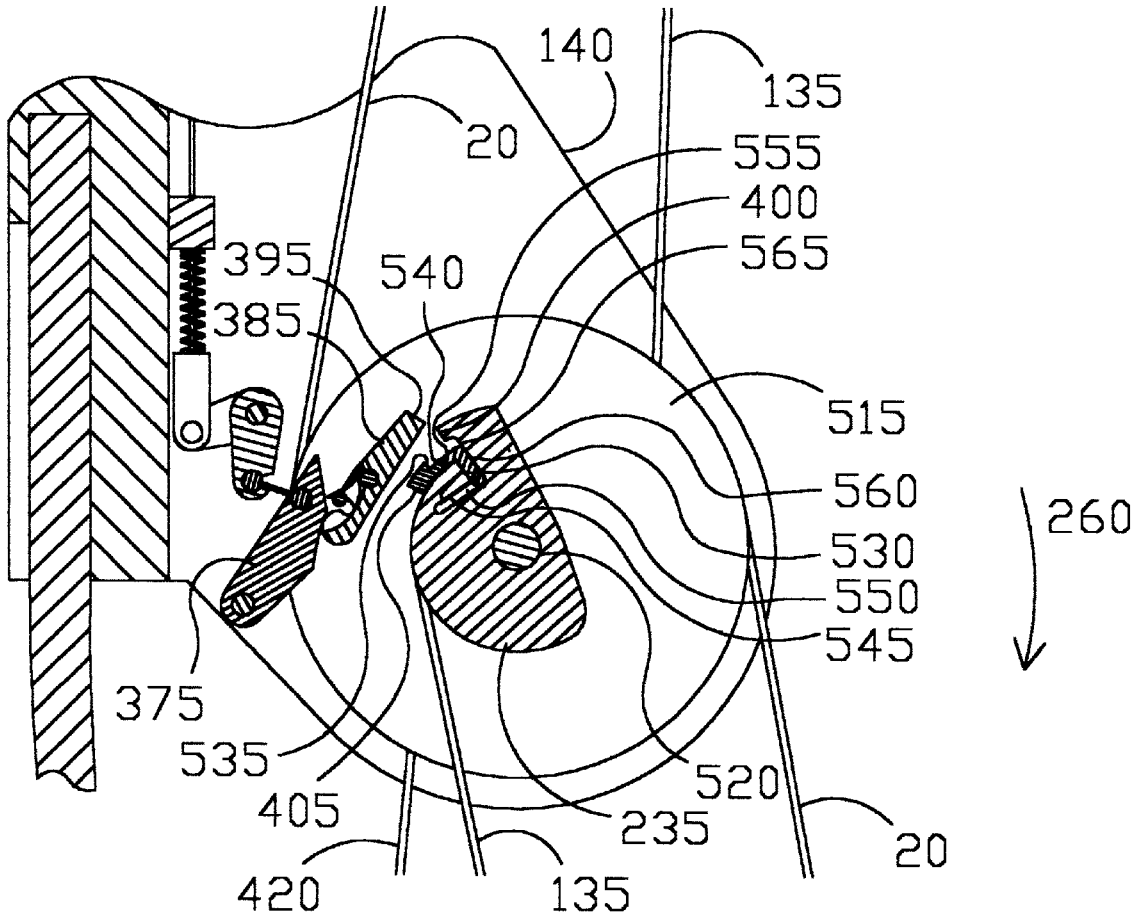
FIG. 7A is a sectioned view of the second cam pulley with the centrifugal tab in a first resting position.
Figure 7B:
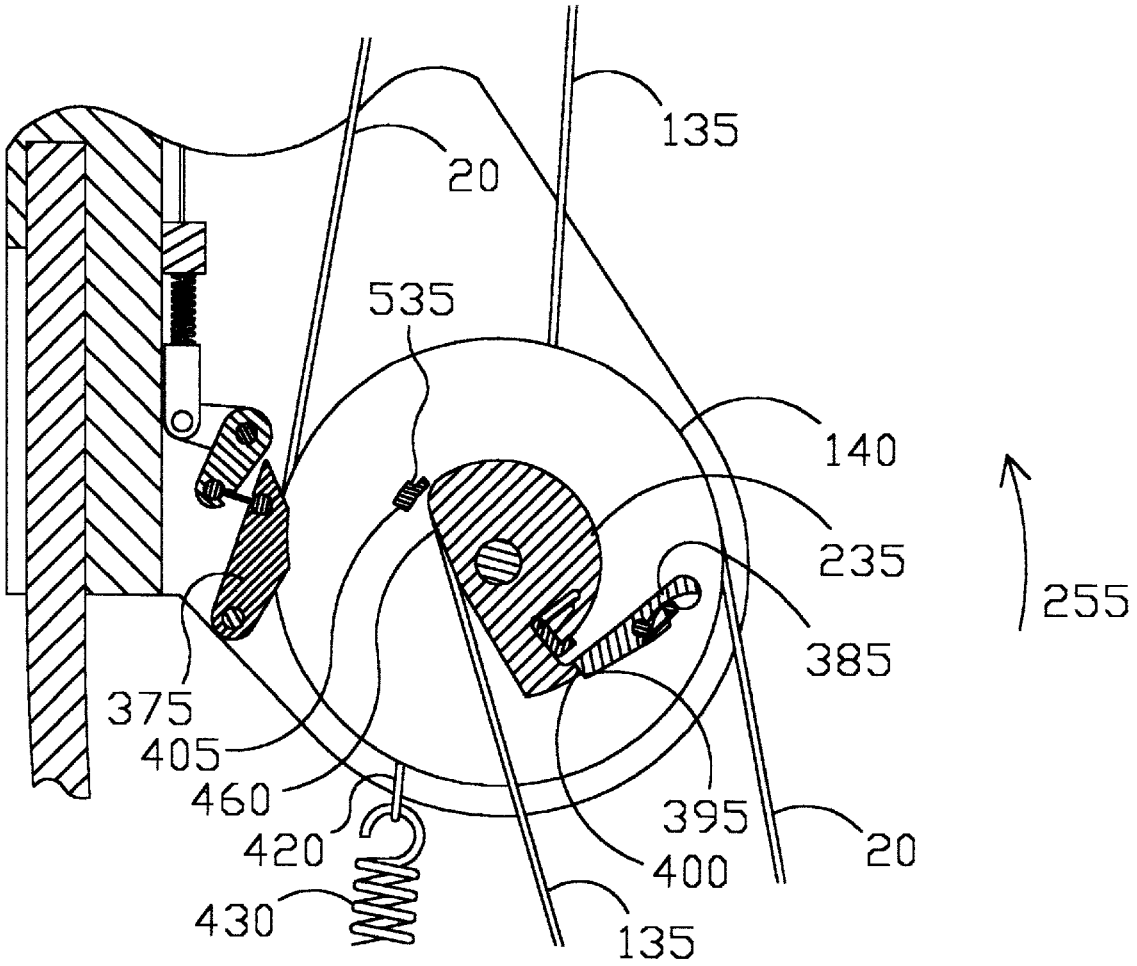
FIG. 7B is a sectioned view of the second cam pulley with the centrifugal tab in the second full drawn position.

To reduce the amount of sound or vibration associated with the striking of the second cam recess 400 with the positional stop 405 during arrow launch a centrifugal tab 530 can be added to the second cam pulley 235 as shown in FIG. 7A. This figure is a sectional view through the second cam pulley 235 with the bow in the first resting position 25 similar to that shown in FIG. 6A. The components are like those described in FIG. 6A–6C except for those components which are now described. The positional stop 405 has been configured such that it has a positional stop step 535 and a positional stop head 540. In the first resting position 25 a flat spring 545 applies a force to move the centrifugal tab 530 into contact with a second cam slot 550. The head 540 of the positional stop is in contact with a centrifugal tab head 555 as shown in FIG. 7A.

During the second full draw of the draw string (FIG. 7B), the positional latch head 395 latches with the second cam recess 400 and rotates the second cam pulley 235 until the tackle line 135 is positioned in the second cam configured let-off 460 position of the second cam pulley 235, in a manner similar to that described in FIG. 6C. As the archer activates the safety release 195 and releases the draw string 20, the tackle line 135 pulls the second cam pulley 235 in a counterclockwise 255 direction. The second cam recess 400 pushes against the head 395 of the positional latch forcing the positional latch 385 and the second draw pulley 515 to rotate counterclockwise 255.

Figure 7C:
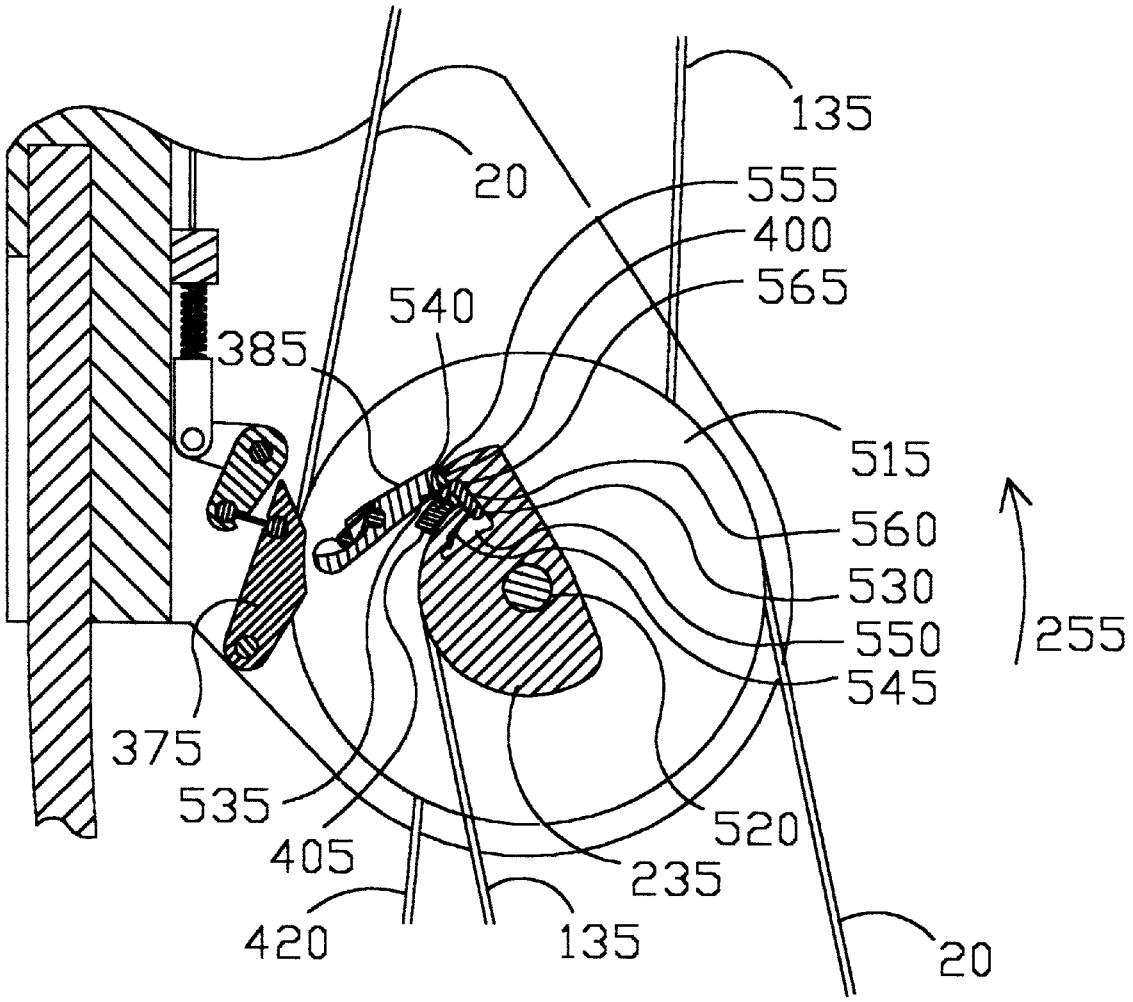
FIG. 7C is a sectioned view of the second cam pulley with the centrifugal tab during overtravel of the second cam pulley.

Due to the rotation of the second cam pulley 235 (FIG. 7C) in a counterclockwise 255 direction, centrifugal force acts upon the centrifugal tab 530 forcing a centrifugal tab shoulder 560 into contact with a second cam pulley shoulder 565 and allowing the head 555 of the centrifugal tab to avoid contact with the head 540 of the positional stop during over-travel of the second cam pulley 235 due to the step 535 in the positional stop 405 as shown in FIG. 7C. Over-travel can be present due to inertial effects associated with the return of all moving components from the full drawn position back to the first resting position. Once the draw string 20 has returned to its first resting position 25 and the second cam pulley 235 and second draw pulley 515 are no longer rotating, the flat spring 545 pulls the centrtifugal tab 530 back toward the second cam slot 550. A slight pull on the draw string rotates the second cam pulley 235 clockwise 260 with the positional latch 385 allowing the centrifugal tab 530 to move into the second cam slot 550 as shown in FIG. 7A, and after releasing the draw string 20 the bow 15 is ready to undergo the next first full draw.

Figure 8:
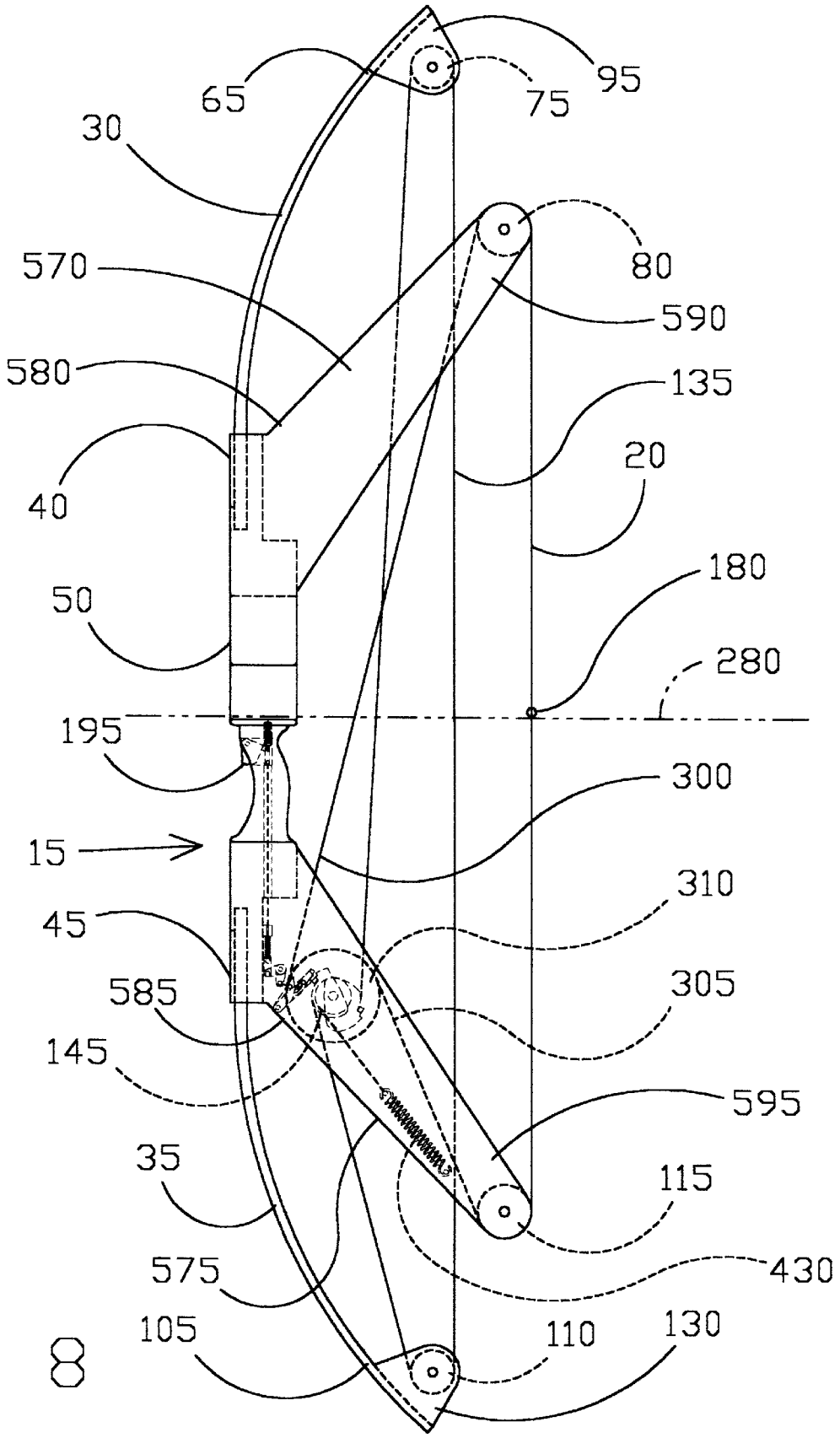
FIG. 8 is a plan view of the bow of the second embodiment of the present invention with rigid and flexible limbs.

FIG. 8 is a plan view of a second embodiment of the bow of this invention. This bow has exactly the same block and tackle mechanism 145 as has been described previously in FIGS. 3–7. The major differing aspect found in this embodiment is the presence of an upper rigid limb 570 and a lower rigid limb 575. A fixed end 580 of the upper rigid limb is rigidly attached to the upper handle-riser end 40 and a fixed end of a lower rigid limb 585 is rigidly attached to the lower handle-riser end 45. Free ends of the upper 590 and lower 595 rigid limbs have an upper 80 and lower 115 idler pulley attached, respectively, and provide passage for the draw string 20. The free ends of the upper 65 and lower 105 flexible limbs have upper 95 and lower 130 limb block devises attached which hold upper 75 and lower 110 block pulleys, respectively, that provide passage for the tackle line 135. The fixed ends of the upper and lower flexible limbs attach to the upper and lower handle-riser ends, respectively, similar to the attachment as was shown in FIG. 1A. The upper rigid limb 570 along with the upper flexible limb 30 form an upper limb means. The free end of the upper limb means is attached to the upper block pulley 75 to provide passage of the tackle line 135 and upper idler pulley 80 to provide for passage of the draw string 20. The fixed end of the upper limb means is attached to the upper handle riser end 40. A lower limb means is comprised of components which are similar to the components of the upper limb means. A fixed end of the lower limb means is attached to a lower handle-riser end 45. The block and tackle mechanism 145 is mounted to the handle-riser 50 or lower rigid limb 575 and the draw string return spring 430 is attached to the lower rigid limb 575 or other bow component. The tackle line 135 and draw string 20 attach to the block and tackle mechanism 145 in the same way as was described in FIGS. 3–7. Other aspects of the bow including the safety release 195 are also the same as described in FIGS. 3–7.

The upper 570 and the lower 575 rigid limb can each be considered a structural means responsible for supporting an upper 80 and a lower 115 idler pulley respectively. This structural means is not required to store deformation energy. The upper 30 and lower 35 flexible limbs shown in FIG. 1*a* can also be considered structural means which serve to support the upper 80 and lower 115 idler pulleys, respectively, as well as deform to store deformation energy.

One advantage of the rigid limbs 570 & 575 shown in FIG. 8 is that the upper 80 and lower 115 idler pulleys are held at a constant distance from the handle-riser 50 during each of the plurality of draws. Therefore each full draw of the draw string has the same draw length and is not dependent upon limb flexibility. The storage of deformation energy from each full draw is not dependent upon matching the flexibility characteristics of each flexible limb. Another advantage of providing the upper 570 and lower 575 rigid limbs is that the nocking point 175 on the draw string is required to move in a straight line in the direction of arrow launch. As shown in FIG. 3A, the draw string 20 is attached at the upper 300 and lower 305 draw string end to a draw pulley mechanism 310. The draw string 20 forms a loop of constant length from the draw pulley mechanism 310, passing around the upper idler pulley 80, passing around the lower idler pulley 115, and back to the draw pulley mechanism 310. Since the upper 570 and lower 575 rigid limbs do not flex and the draw string ends 300 & 305 are attached to a common draw pulley mechanism 310, the nocking point 180 of the draw string is required to move in a straight line along the centerline of the bow 15 during arrow launch providing a more accurate straight line arrow travel. This same concept of maintaining a draw string loop of constant length can also be accomplished with a pivoting linkage 85 & 120 as described in FIGS. 1B & 1C.

The flexible limbs 30 & 35 shown in FIG. 8 serve to store the energy of each full draw of the draw string 20. It is not required that the upper 30 and lower 35 flexible limbs be matched together such that they have nearly identical flexibility and stress-strain characteristics as is required with standard compound bows. Standard bows must match the upper and lower flexible limbs to ensure a straight line travel for the nocking point along the centerline. This is particularly true of standard compound bows that have cam pulleys placed at the free end of each flexible limb. Standard compound bows of this type require further syncronization of the cam pulleys to ensure that the nocking point moves in a straight line. The bow 15 of this invention does not require syncronization due in part to round axisymmetric pulleys that are placed at the free end of each rigid limb. The movement of the draw string from the second full draw 185 back to the first resting position 25 as the arrow is launched is a smooth, quiet and vibration free due to the smooth configured cam pulley configuration and their positioning as part of the block and tackle mechanism 145.

It is understood from examination of FIG. 8 that only one of the flexible limbs 30 & 35 is necessary to store deformation energy from the plurality of draws of the draw string 20. Either the upper 30 or lower 35 flexible limb could be eliminated without affecting the capability of the bow of this invention 15 from undergoing a plurality of draws, storing the deformation energy from each draw, holding the deformation energy, releasing the deformation energy, and delivering the combined deformation energy of the total plurality of draws to the arrow for launch. Elimination of the lower flexible limb 35 would require that the lower block pulley 110 be mounted onto the free end of the lower rigid limb 595. A similar requirement would apply to an elimination of the upper flexible limb 30. The presence of a singular flexible limb may lead to an imbalance of force that is normally balanced with two flexible limbs 30 & 35 as the limbs return from a final deformed state 190 back to the first resting position 25 during arrow launch. An imbalance of force can result in unwanted movement of the bow 15 disturbing the accuracy of the arrow being launched.

Figure 9:
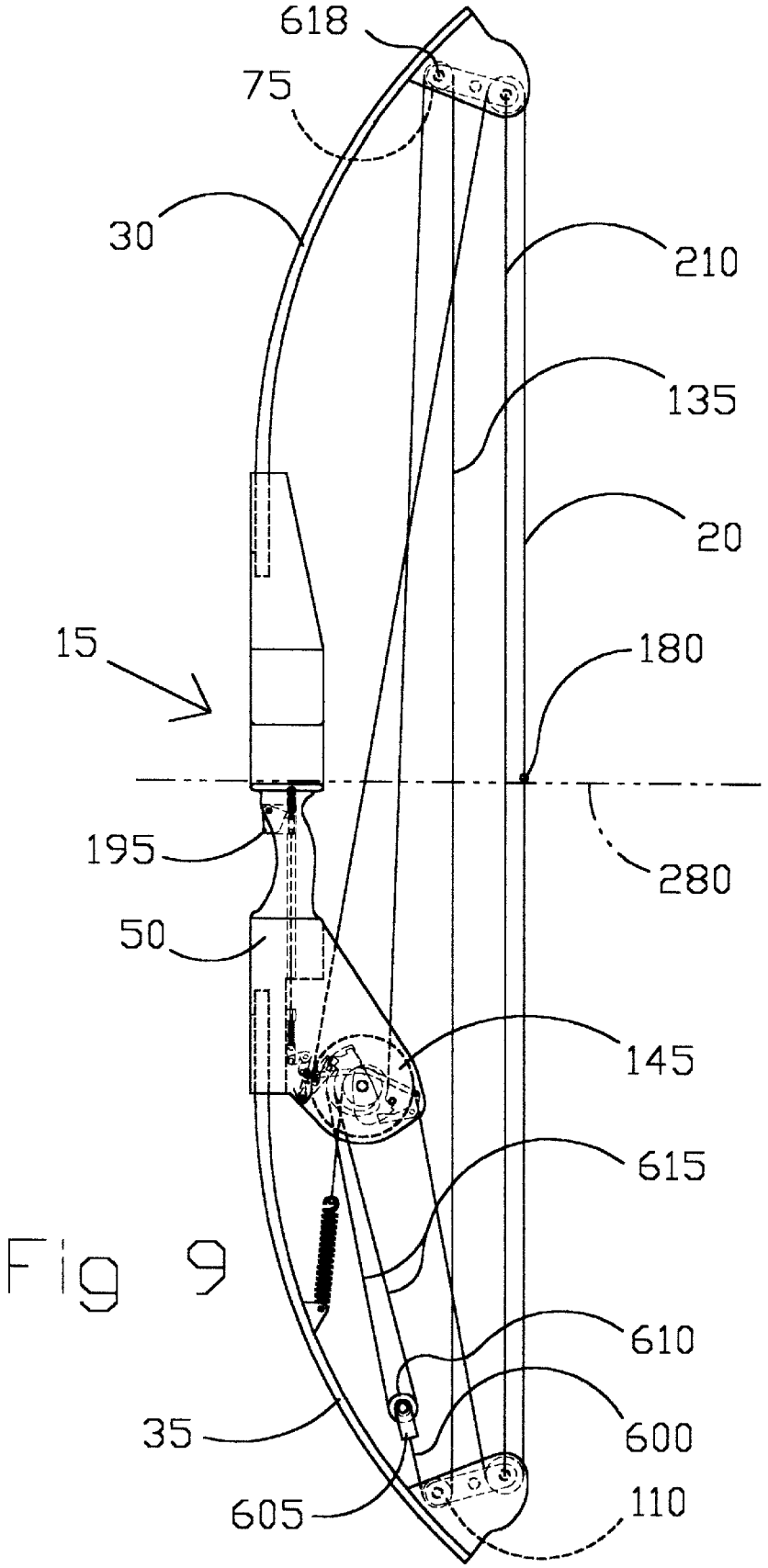
FIG. 9 is a plan view of an alternate embodiment of a bow of the present invention requiring three draws of the draw string.

FIG. 9 shows a plan view of an embodiment of the bow of this invention in a first resting position and capable of a plurality of three draws of the draw string. For purposes of presentation a bow similar to that shown in FIG. 1A is shown although the same explanation could be applied to the embodiment shown in FIG. 8. Only those aspects of FIG. 9 that are specifically related to providing three or more draws of the draw string will be discussed. All other components are the same as those described in FIG. 1*a*.

To enable the bow of the present invention to undergo three draws, the tackle line 135 passes from the upper block pulley 75 to the lower block pulley 110 as described previously. After passing through the lower block pulley 110, the lower tackle line end 600 attaches to a secondary tackle line clevis 605 which supports a secondary block pulley 610. A secondary tackle line 615 passes through the secondary block pulley 610 with each end of the secondary tackle line being attached to the block and tackle mechanism 145 which will be described later in FIGS. 10A–10G. The secondary tackle line 615 along with the secondary block pulley 610, the secondary tackle line clevis 605, and the tackle line together constitute a tackle line means. The tackle line means passes from the block and tackle mechanism 145 through the lower block pulley 110, through the upper block pulley 75, and back to the block and tackle mechanism 145. Details of the block and tackle mechanism 145 will be discussed later in FIGS. 10A–10G.

It is further understood and herein discussed that the bow 15 of the present invention could be modified further to provide for four draws of the draw string or more draws if desired. To add an additional draw of the draw string requires an additional or tertiary tackle line clevis (not shown) containing an additional or tertiary block pulley (not shown). The tertiary tackle clevis is terminally attached to an end of an existing tackle line or secondary tackle line located between the upper or lower block pulley and the block and tackle mechanism. The block and tackle mechanism that provides four draws is described later in the text for FIGS. 10A–10G. The tertiary block pulley provides passage for a tertiary tackle line with each end being attached to the block and tackle mechanism in a manner similar to that shown for the triple draw bow of this invention. Similar to the discussion for the triple draw bow, the four draw bow (not shown) has a tackle line means that consists of a tertiary and secondary tackle clevis, a tertiary and secondary block pulley, a tertiary tackle line, a second tackle line and the tackle line.

The bow 15 of the present invention has been described in all previous embodiments such that it has both an upper block pulley 75 and a lower block pulley 110 attached to an upper 30 and lower 35 flexible limb, respectively. The tackle line 135 interfaces with the upper 30 and lower 35 flexible limbs as it comes in contact with and passes through these block pulleys 75 & 110 causing both limbs 30 & 35 to flex and store deformation energy. It is within the teachings of the present invention to provide an additional embodiment that contains only one block pulley attached to a flexible limb. For example, the bow 15 may contain only the lower block pulley 110 attached to the lower flexible limb 35 and eliminate the upper block pulley 75. This embodiment can be understood by referring to FIG. 9 where it is seen that the tackle line 135 interfaces with or comes in contact with the upper flexible limb as it passes through the upper block pulley 75 and the tackle line 135 attaches to the block and tackle mechanism 145 at the upper tackle line attachment site 330. In the additional embodiment, the tackle line 135 interfaces or contacts the upper flexible limb 30 by attaching directly to the upper pivoting linkage 85 at an interface site 618 (FIG. 9). The upper block pulley 75 for the additional embodiment has therefore not been used and can be eliminated. The additional embodiment of the bow of this invention thus has two block pulleys such as those shown by the lower block pulley 100 and the secondary block pulley 610 and is suited for two draws of the draw string 20.

Another way of understanding and interpreting this additional embodiment is by recognizing that the bow of the present invention that requires two draws contains two block pulleys, one for each draw. The locations of the block pulleys can be such that one block pulley is located on each flexible limb as shown in FIG. 1*a*. Another possibility as presented in this additional embodyment is to position the two block pulleys as shown in the lower half of FIG. 9, with one block pulley 100 affixed to the lower flexible limb 35 and the other block pulley becoming the secondary block pulley 610. The tackle line 135 for this embodiment comes in direct contact with the interface site 618 of the upper flexible limb 30 forming a fixed attachment. This understanding can be further extended to the bow of the present invention requiring three or more draws. In the bow of the present invention requiring a plurality of draws only one block pulley, for example the lower block pulley, is required to be affixed to the flexible limb in order to provide for deformation of that limb and the storage of deformation energy in that flexible limb. The upper flexible limb 30 of this embodiment can be flexible as described in all of the previous embodiments and as shown in FIG. 9, or it can become a rigid limb thereby causing the lower flexible limb 35 to undergo all of the deformation and storage of deformation energy.

Figure 10A:
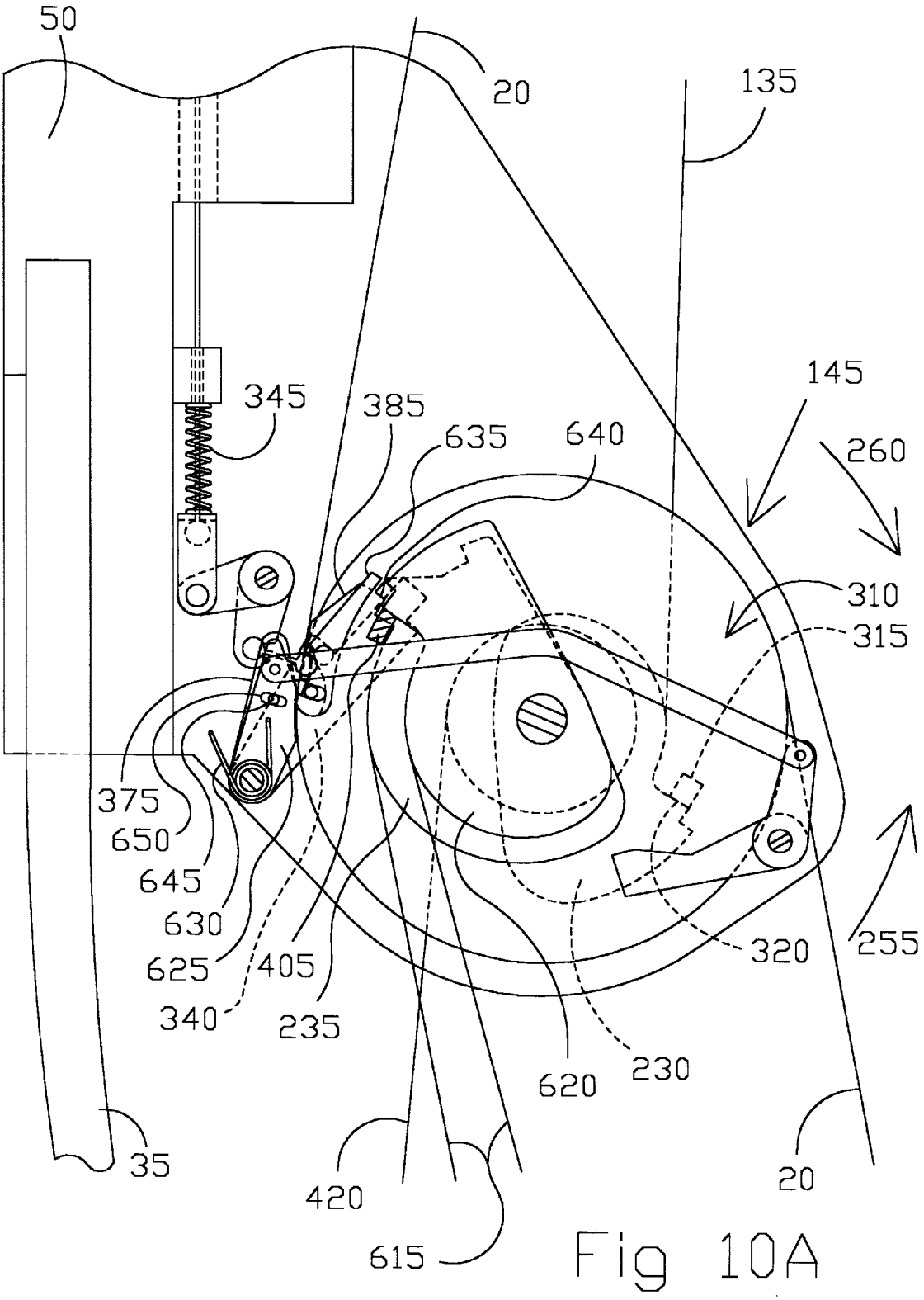
FIG. 10A is a sectioned view of a block and tackle mechanism for providing three draws of the draw string in a first resting position.
Figure 10B:
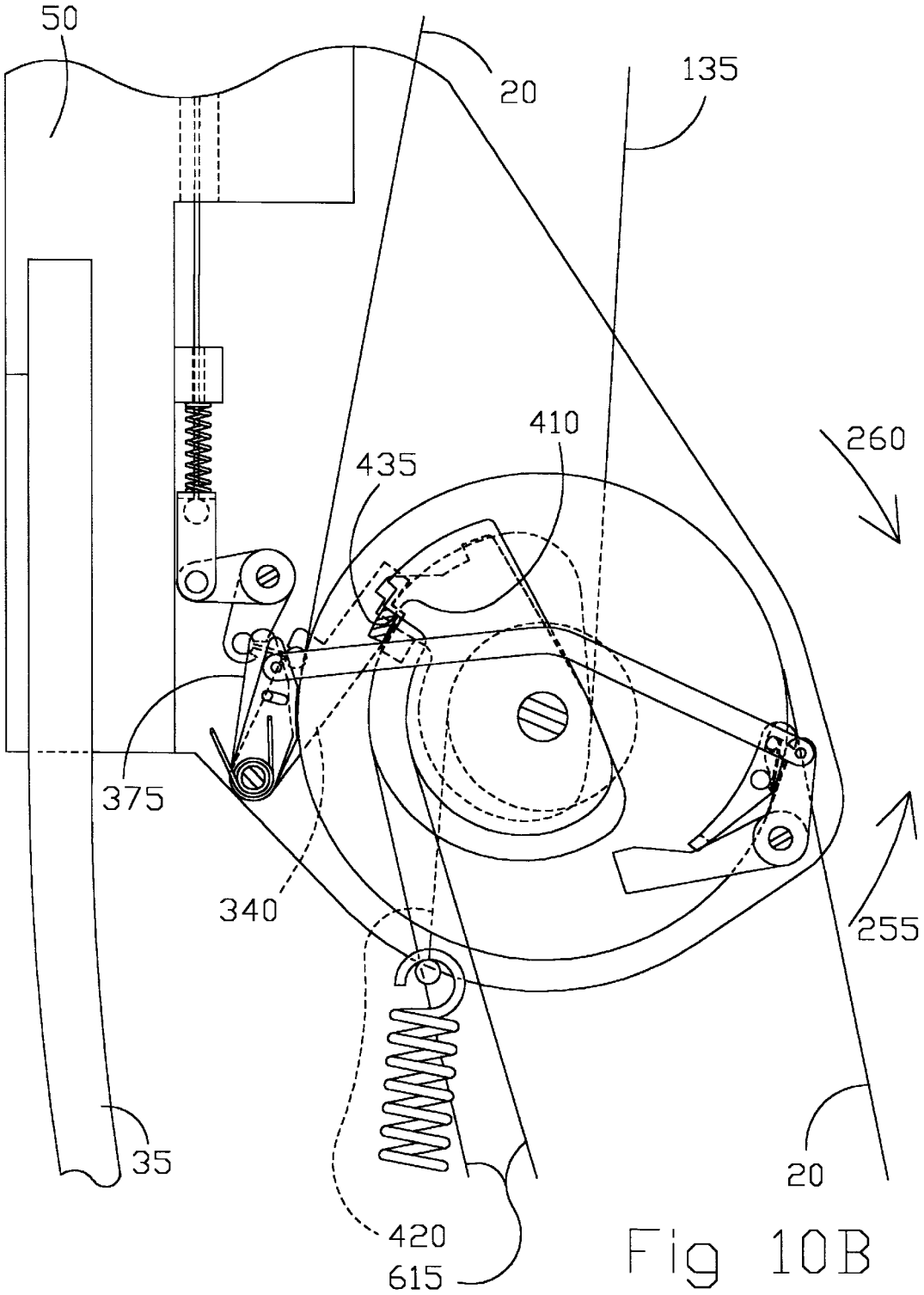
FIG. 10B is a sectioned view of a block and tackle mechanism for providing three draws of the draw string in a first full drawn position.
Figure 10C:
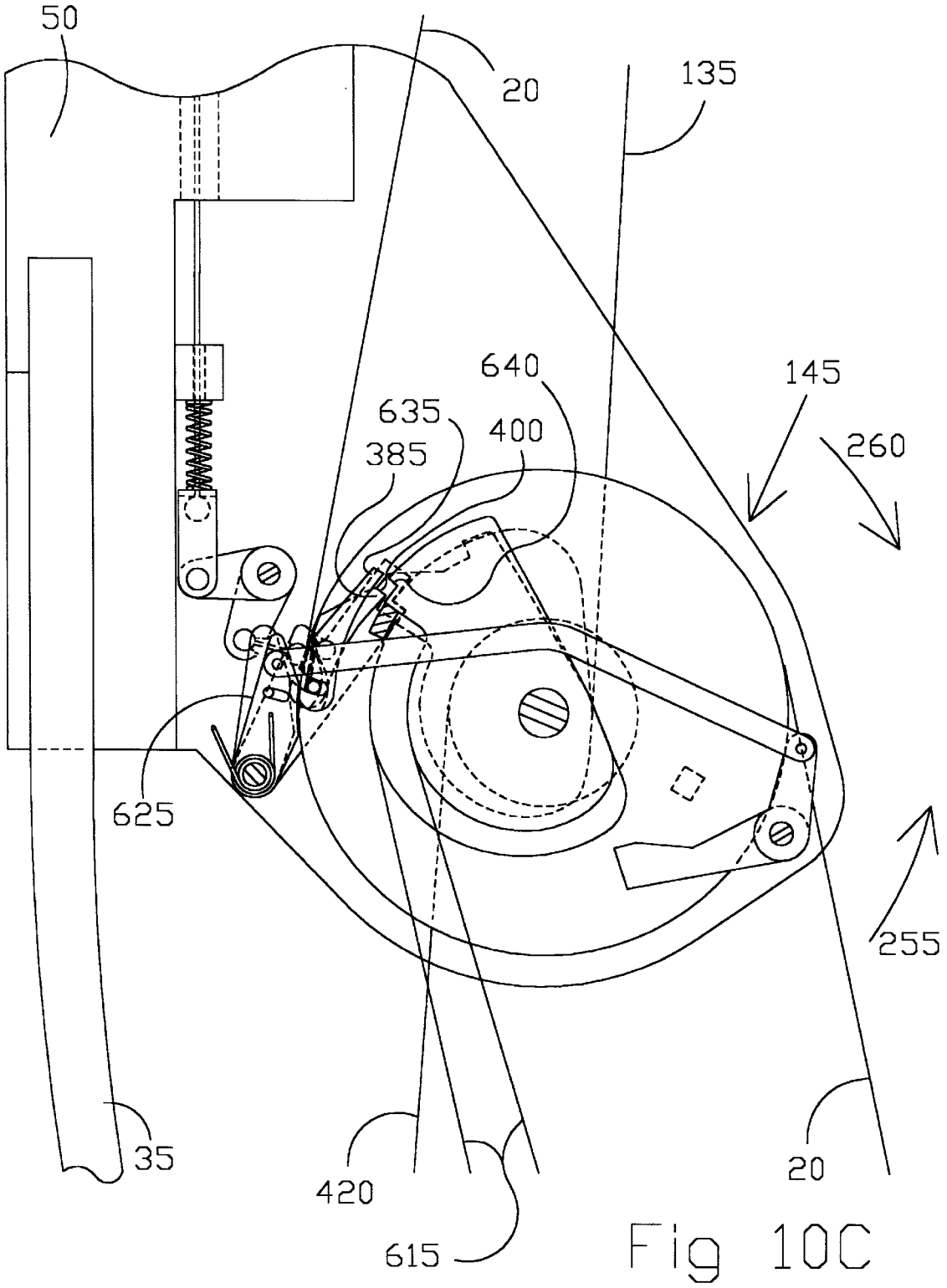
FIG. 10C is a sectioned view of a block and tackle mechanism for providing three draws of the draw string in a second resting position.

The block and tackle mechanism of this embodiment for providing three draws of the draw string 20 is described in FIGS. 10A–10C and performs the same function as the block and tackle mechanism described in FIG. 3A except that the three draw embodiment comprises three cam pulleys instead of two, and two cam latches instead of only one. The three cam pulleys together can be considered a tackle pulley means. The tackle pulley means attaches to the tackle line means and provides a let-off of force for each draw of the draw string as will be described in FIGS. 10A–10G. Many of the components are the same as shown in FIGS. 3A–3E and bear the same reference numerals.

As shown in FIG. 10A, the block and tackle mechanism 145 for this embodiment is in a first resting position 25. As the draw string 20 is drawn to a first full draw, the draw pulley mechanism 310 rotates clockwise 260 causing the index stop 315 to push the first cam tab 320 of the first cam pulley 230 clockwise 260. A positional stop 405 prevents counterclockwise 255 rotation of either a second 235 or third cam pulley 620. A first cam latch extension 375 attached to a first cam latch 340 is held in position by a first cam latch spring 345. The first cam latch extension 375 holds a first positional latch 385 attached to the draw pulley mechanism 310 such that the positional latch 385 misses a second cam recess 400 during the clockwise 260 rotation of the draw pulley mechanism 310 as shown in FIGS. 10A & 10B. A second positional latch holder 625 located above the first cam latch extension 375 of FIG. 10A as shown in FIG. 10B is held in position by a second positional latch holder spring 630. The second positional latch holder 625 holds a second-positional latch 635 attached to the draw pulley mechanism 310 and is located above the positional latch 385 of FIG. 10A and is seen in FIG. 10C. The second-positional latch 635 misses a third cam positional recess 640 during clockwise 260 rotation of the draw pulley mechanism 310 during the first full draw of the draw string 20. An extension pin 645 attached to the first cam latch extension 375 slidingly fits within a holder slot 650 located in the second positional latch holder 375.

FIG. 10B shows the first cam recess engaged with the first cam latch recess with the bow in the first full drawn position. Movement of the first cam latch to a latched position has resulted in movement of the first cam latch extension.

The block and tackle mechanism 145 of this embodiment positioned in the second resting position is presented in FIG. 10C. The positional latch 385 has engaged the second cam recess 400. The second positional latch 635 is being held by the second positional latch holder 625 in a position that will not engage the third cam recess 640.

Figure 10D:
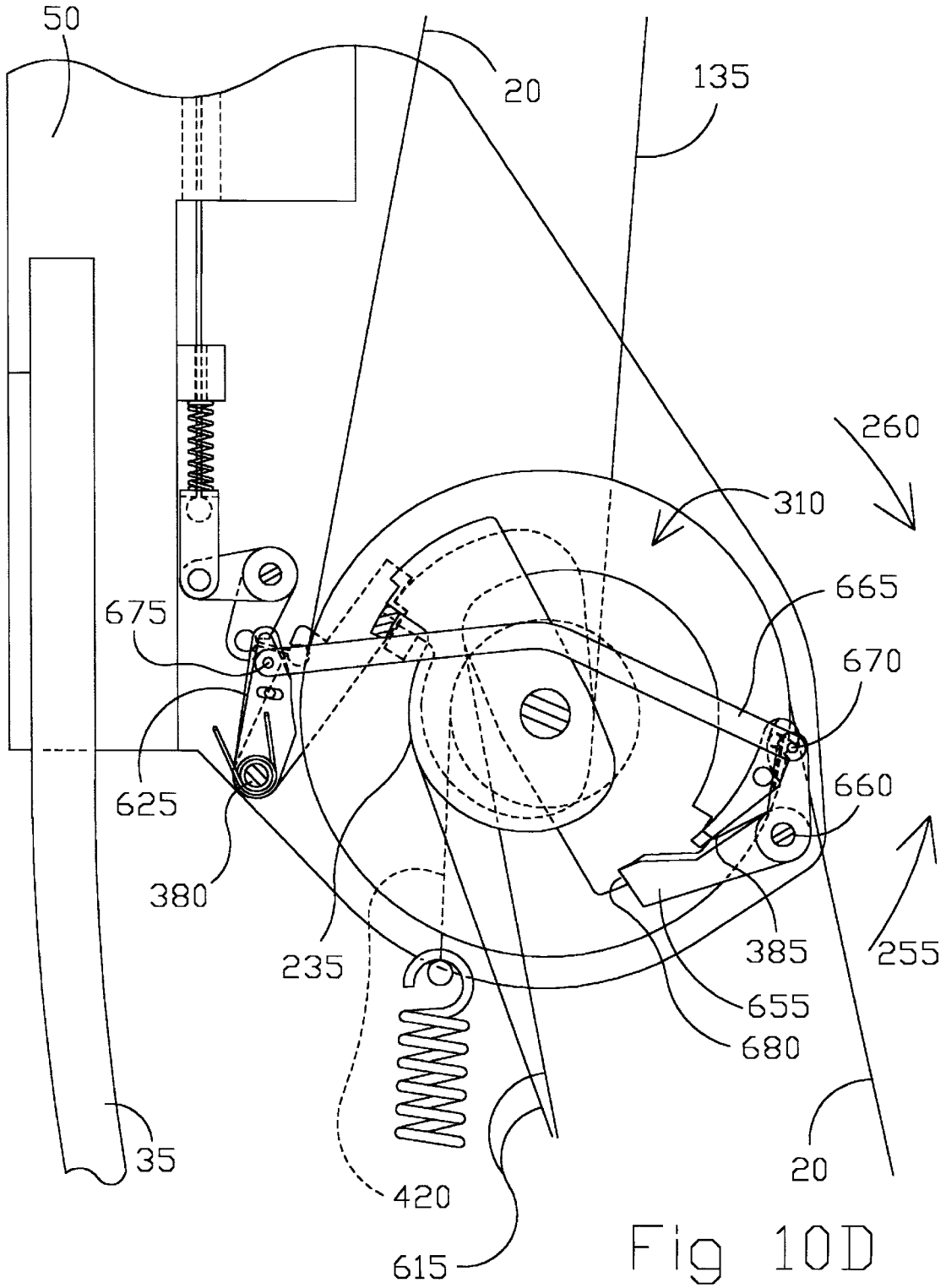
FIG. 10D is a sectioned view of a block and tackle mechanism for providing three draws of the draw string in a second full drawn position.

In FIG. 10D the draw string 20 has been drawn to a second full drawn position, causing the draw pulley mechanism 310 to rotate clockwise 260. The first positional latch 385 has rotated the second cam pulley 235 clockwise 260. A second cam latch 655 is pivotally attached to the block and tackle housing of this embodiment at a second cam latch pivot 660. A latch linkage 665 pivotally connects the second cam latch 655 at a latch linkage pivot 670 to a linkage holder pivot 675 of the second positional latch holder 625. As the second cam latch 655 engages the second cam notch 680, the second cam latch 655 pivots about the second cam latch pivot causing the latch linkage 665 to rotate the second positional latch holder 625 about a first cam latch pivot 380.

Figure 10E:
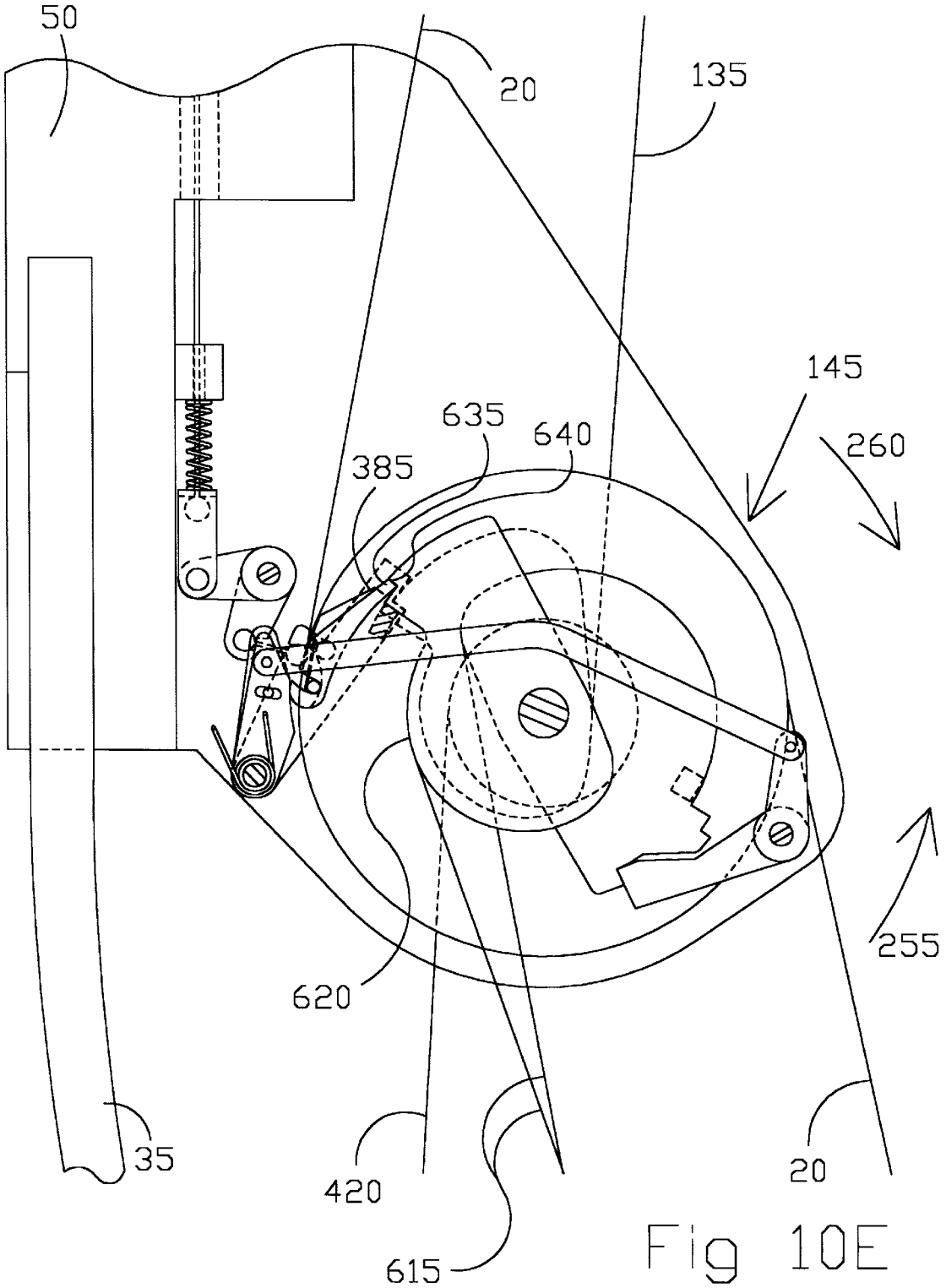
FIG. 10E is a sectioned view of a block and tackle mechanism for providing three draws of the draw string in a third resting position.
Figure 10F:
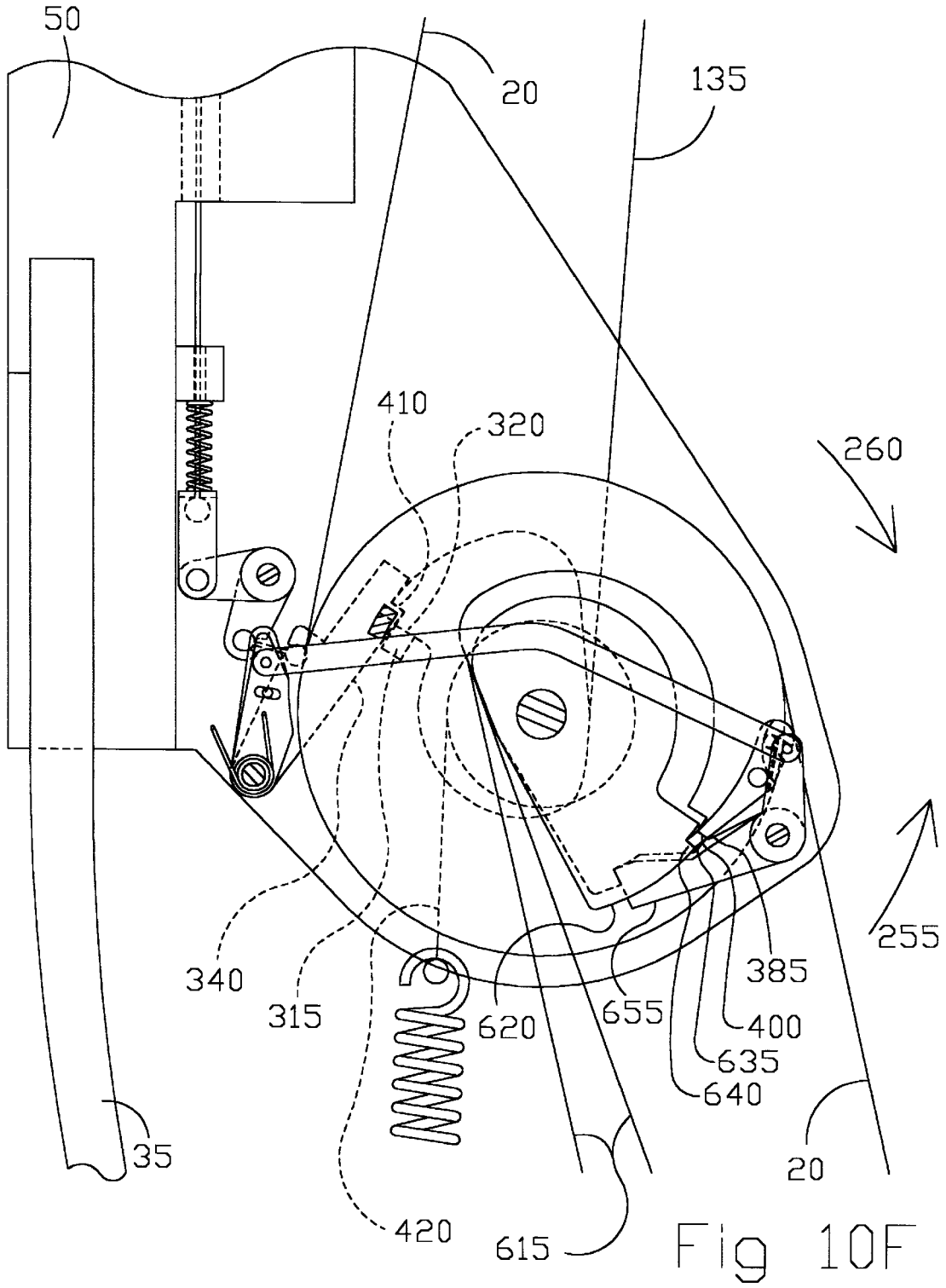
FIG. 10F is a sectioned view of a block and tackle mechanism for providing three draws of the draw string in a third full drawn position.

The third resting position of the block and tackle mechanism 145 of this embodiment is shown in FIG. 10E. The second positional latch 635 positioned directly above the positional latch 385 is in a position to latch the third cam recess 640 of the third cam pulley 620.

During the third draw of the draw string 20, (FIG. 10F) the third cam pulley 620 is rotated clockwise 260 by the second positional latch 635. The positional latch 385 which is located beneath the second positional latch 635 and has also been rotated clockwise 260, makes contact with the second cam recess 400 positioned beneath the third cam recess 640. Contact is also made between the index stop 315 and the first cam tab 320. In this position, frictional forces that are holding the first 340 and second 655 cam latch into contact with the first cam recess 410 and the second cam recess 400 have been removed.

Figure 10G:
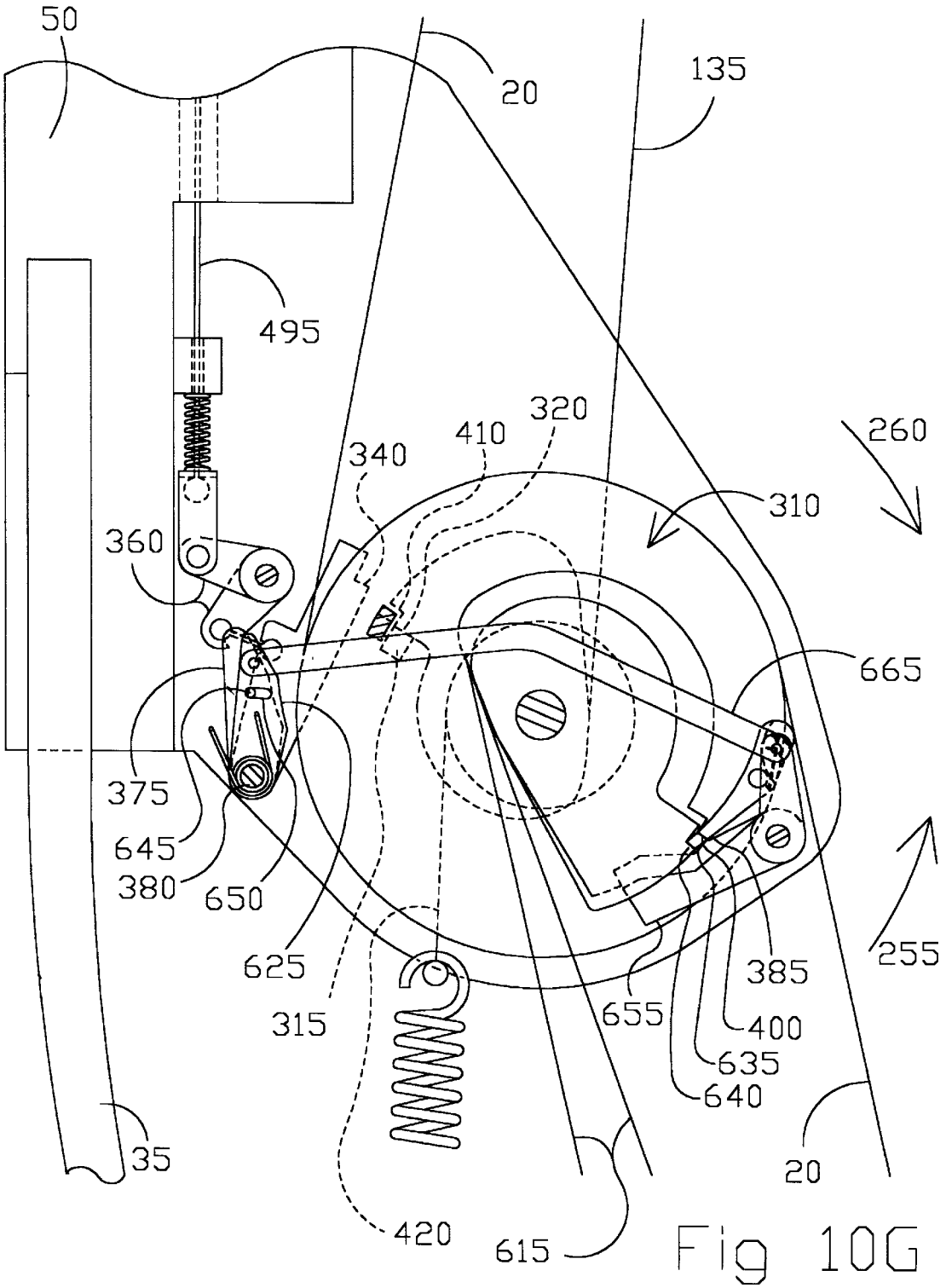
FIG. 10G is a sectioned view of a block and tackle mechanism for providing three draws of the draw string in a third full drawn position with the safety release activated.

Activation of the safety release 195 (FIG. 9) by the archer results in upward movement of the connecting line 495, (FIG. 10G) rotation of the bell crank 360, and rotation of the first cam latch 340 about the first cam latch pivot 380 as seen in FIG. 10G. Activation of the safety release unlatches the first cam latch 340 from the first cam recess 410. Rotation of the first cam latch 340 also causes rotation of the first cam latch extension 375 resulting in movement of the extension pin 645 within the holder slot 650 causing rotation of the second positional latch holder 625 causing movement of the latch linkage 665 resulting in the pivotal unlatching of the second cam latch 655. The intermediate deformation energy that was held in the flexible limbs by the first 340 and second 655 cam latches is now available to be combined with the final deformation energy associated with the third full draw to be delivered to the draw string 20 to launch the arrow. The first cam tab 320 pushes the index stop 315 counterclockwise 255. The second 400 and third cam recesses 640 push the positional 385 and second-positional 635 latches, respectively, to rotate the draw pulley mechanism 310 counterclockwise 255 causing the draw string 20 to return to the first resting position and launch the arrow.

The first 230, second 235, and third 620 cam pulleys are involved with the take-up and pay-out of tackle line 135, and can be considered a tackle pulley means. For the block and tackle mechanism of this embodiment requiring three draws, the tackle pulley means is shown to be comprised of three cam pulleys whereas the tackle pulley means is comprised of only two cam pulleys for the bow requiring only two draws of the draw string 20. The bow requiring three draws requires a first 340 and second 655 cam latch to hold the first 230 and second 235 cam pulleys, respectively. These two cam latches constitute a latch means which holds the intermediate deformation energy of the flexible limbs for the first two draws of the draw string 20. The latch means for a bow requiring only two draws of the draw string consists of only one latch. Extending this reasoning to an alternate embodiment of the bow of this invention that requires four draws of the draw string indicates that the block and tackle mechanism would contain four cam pulleys and three cam latches.

Mode of Operation

The mode of operation for all embodiments of the present invention are the same and reference can be made to FIGS. 1–10. To use the multiple draw archery bow of the first or second embodiment of the present invention the draw string is drawn back from a first resting position 25 to a first full drawn position 150 deforming the flexible limbs 30 & 35 to an intermediate state of deformation 160 storing deformation energy in the limbs 30 & 35. The intermediate draw force required to accomplish the first full draw 150 is less than that required by a standard compound bow due to the presence of a mechanical block and tackle mechanism 145. The mechanical block and tackle mechanism 145 also provides let-off of force for the first full draw 150. The deformation energy of the flexible limbs 30 & 35 is automatically stored by a latch means located in the block and tackle mechanism 145. The draw string 20 is then returned to a second resting position 175 by a draw string return spring means. The archer may next attach the arrow nock to the nocking point 180 of the draw string 20 and draw the draw string back to a second full drawn position 185. The mechanical mechanism again offers a lower draw force for the second full draw 185 than for a standard compound bow and also provides for let-off of force for the second full draw 185. The flexible limbs 30 & 35 have deformed an additional amount storing the deformation energy from the first two full draws of the draw string 20. In the let-off region 460 of the second full draw position 185, the archer activates a safety release 195 and waits for an appropriate time to launch the arrow. Due to the mechanical block and tackle mechanism 145, arrow launch occurs with the nocking point 180 of the draw string 20 following a precise linear path in the direction of arrow travel independent of variations in flexibility between the two flexible limbs 30 & 35.

Following arrow launch the mechanical block and tackle mechanism 145 of the bow 15 has returned to the first resting position 25 and is ready for the archer to repeat the launch sequence. If the archer decides not to launch the arrow following the second full draw 150, the safety release 195 can be deactivated by digitally releasing the safety release 195. The draw string 20 can then be returned to the second resting position 175 at an intermediate draw force with the deformation energy associated with an intermediate state of deformation 160 of the first full draw 150 still stored in the flexible limbs 30 & 35. The second full draw 185 can then be accomplished at any later time the archer wishes to launch the arrow.

With two draws of the draw string an individual of average strength can launch an arrow with approximately twice the energy of a standard compound bow. An individual of lower strength who can generate only half of the draw force of an average strength individual, can launch an arrow with the same energy as the average strength individual.

The block and tackle principles described in the primary and secondary embodiment of the bow of the present invention can also be applied to the alternate embodiment which requires three draws, or to the bow 15 of the present invention requiring four or more draws of the draw string 20. The multiple draw archery bow requiring three draws of the draw string 20 has two intermediate full draws of the draw string 20 followed by a final, third draw of the draw string 20. The multiple draw archery bow 15 of the present invention requiring four draws of the draw string 20 has three intermediate full draws followed by a final fourth draw of the draw string 20.

To use the multiple draw archery bow 15 of the present invention requiring three or more draws of the draw string prior to launching the arrow, the draw string 20 is drawn back from a first resting position 25 to a full draw position 150 & 185 a plurality of two or more intermediate full draws deforming the flexible limbs 30 & 35 to an intermediate state of deformation 160 storing deformation energy in the flexible limbs 30 & 35. The intermediate draw force required to accomplish the plurality or two or more intermediate full draws is less than that required by a standard compound bow due to the presence of a mechanical block and tackle mechanism 145. The mechanical block and tackle mechanism 145 also provides let-off of force for the plurality of two or more full draws. The deformation energy of the flexible limbs 30 & 35 is automatically stored by a latch means located in the block and tackle mechanism 145. The draw string 20 is then returned to a third resting position or a final resting position for the case of more that three draws of the draw string 20 by a draw string return spring means. The archer may next attach the arrow nock to the nocking point 180 of the draw string 20 and draw the draw string 20 back to a third or final full drawn position. The mechanical block and tackle mechanism 145 again offers a lower draw force for the third or final full draw than for a standard compound bow and also provides for let-off of force for the third or final full draw. The flexible limbs have deformed an additional amount storing the deformation energy from the first three or more full draws of the draw string 20. In the let-off region of the third or final full draw position, the archer activates a safety release 195 and waits for an appropriate time to launch the arrow.

Various modifications can be made to the present invention without departing from the apparent scope hereof.

We claim:

1. An archery bow for launching an arrow, comprising:

a handle-riser;

an upper flexible limb having a fixed end mounted to an upper end of the handle-riser, and a free end; a lower flexible limb having a fixed end mounted to a lower end of the handle-riser, and a free end;

an upper idler pulley attached to the handle-riser, and a lower idler pulley attached to the handle-riser;

an upper block pulley attached at the free end of the upper flexible limb, and a lower block pulley attached at the free end of the lower flexible limb;

a block and tackle mechanism attached to the handle-riser;

a draw string for providing direct contact with an arrow for launching the arrow, the draw string having a first end connected to said block and tackle mechanism, and being received about said upper idler pulley and said lower idler pulley, and having a second end connected to said block and tackle mechanism, the draw string movable between a drawn position and a rest position;

a tackle line having a first end connected to said block and tackle mechanism, and being received about said upper block pulley and said lower block pulley, and having a second end connected to said block and tackle mechanism;

said block and tackle mechanism having means for transferring draw energy of the draw string via said tackle line for storing the draw energy in the upper and lower flexible limbs as deformation energy, and for transferring the deformation energy back through said tackle line to the draw string for providing energy to launch an arrow;

said block and tackle mechanism further including means for transferring an intermediate amount of deformation energy via said tackle line to the flexible limbs upon one or more draws of the draw string from the rest position to the drawn position, means for returning the draw string from the drawn position to the rest position without launching an arrow, while maintaining the intermediate amount of deformation energy in the flexible limbs by said tackle line, means for transferring a final amount of deformation energy to the flexible limbs via said tackle line upon at least one additional draw of the draw string from the rest position to the drawn position; means for adding the stored intermediate and final deformation energies into a total deformation energy, and means for transferring the total deformation energy to the draw string for launching an arrow.

2. The archery bow of claim 1 wherein said block and tackle mechanism comprises a tackle line pulley assembly that provides that each of the draws of the draw string requires approximately the same amount of draw force from a resting position to a full drawn position.

3. The archery bow of claim 1 wherein said block and tackle mechanism transfers a lesser draw force of the draw string over a greater displacement, comprising draw lengths for a plurality of draws of the draw string, into a greater launch force delivered to an arrow by the draw string over a lesser displacement, comprising a return of the draw string from the full drawn position to the resting position.

4. The archery bow of claim 1 wherein said upper idler pulley is attached to the free end of the upper flexible limb and the lower idler pulley is attached to the free end of the lower flexible limb.

5. The archery bow of claim 1 further comprising an upper rigid limb being attached to the upper end of the handle-riser and having said upper idler pulley attached thereto, and also further comprising a lower rigid limb being attached to the lower end of the handle-riser and having said lower idler pulley attached thereto.

6. The archery bow of claim 1 wherein said block and tackle mechanism provides for a let-off of draw force for each of the draws of the draw string with the draw string in a full drawn position.

7. The archery bow of claim 1 wherein said upper block and said upper idler pulleys are attached to an upper pivoting linkage, and said lower block and said lower idler pulleys are attached to a lower pivoting linkage, said upper pivoting linkage being pivotally attached to the free end of the upper flexible limb and said lower pivoting linkage being pivotally attached to the free end of the lower flexible limb.

8. The archery bow of claim 7 wherein said upper and lower pivoting linkages are connected to a linkage tie line.

9. The archery bow of claim 8 wherein the handle-riser has an alignment rod attached and extending in a rearward direction, said alignment rod having a cylindrical clip slidingly fit around said alignment rod, said cylindrical clip being attached to said linkage tie line; said linkage tie line, said alignment rod, and said cylindrical clip providing that a nocking point of the draw string travels on a straight line parallel with the centerline of said archery bow to launch an arrow in a straight line.

10. The archery bow of claim 8 wherein the handle-riser has an alignment rod attached and extending in a rearward direction, said alignment rod being attached to said linkage tie line, said linkage tie line and said alignment rod providing that a nocking point of the draw string travels on a straight line parallel with a centerline of said archery bow to launch an arrow in a straight line.

11. The archery bow of claim 7 wherein said pivoting linkage provides that the draw string forms an approximately constant length loop for each draw of the draw string with passage extending from said block and tackle mechanism, through said upper idler pulley, through said lower idler pulley, and extending back to said block and tackle mechanism; the approximately constant length loop allowing each draw of the draw string to contribute a maximum amount of draw energy to be stored as deformation energy of the flexible limbs at the lowest average draw force for the draws of the draw string.

12. An archery bow for launching an arrow, comprising:

a handle-riser;

an upper flexible limb having a fixed end mounted to an upper end of the handle-riser, and a free end; a lower flexible limb having a fixed end mounted to a lower end of the handle-riser, and a free end;

an upper idler pulley attached to the handle-riser, and a lower idler pulley attached to the handle-riser;

an upper block pulley attached at the free end of the upper flexible limb, and a lower block pulley attached at the free end of the lower flexible limb;

a block and tackle mechanism attached to the handle-riser, said block and tackle mechanism comprising:

a draw pulley mechanism, rotatable between a rest position and a drawn position;

means to bias said draw pulley to the rest position;

a tackle line pulley assembly, comprising a plurality of cam pulleys, each rotatable between a rest position and an energy-storing position;

a draw string for providing direct contact with an arrow for launching the arrow, wherein the draw string has a first end connected to said draw pulley mechanism, and is received about said upper idler pulley and said lower idler pulley, and has a second end connected to said draw pulley mechanism, the draw string movable between a drawn position, which rotates said draw pulley mechanism to its drawn position, and a rest position, which allows said draw pulley mechanism to return to its rest position under influence of the bias means;

a tackle line having a first end connected to a first cam pulley, and being received about said upper block pulley and said lower block pulley, and having a second end connected to an additional cam pulley;

said draw pulley mechanism having means for rotating said first cam pulley from its rest position to its energy storage position as the draw string is drawn and said draw pulley mechanism is rotated from its rest position to its drawn position, said first cam pulley taking up a length of said tackle line and storing an intermediate deformation energy in the flexible limbs;

said block and tackle mechanism including means to latch said first cam pulley in its energy storage position, allowing said draw pulley mechanism to return to its rest position as the draw string is relaxed, without firing an arrow;

said draw pulley mechanism having means for rotating said additional cam pulley from its rest position to its energy storage position as the draw string is drawn an additional time and said draw pulley mechanism is rotated from its rest position to its drawn position, said additional cam pulley taking up a length of said tackle line and storing a final deformation energy in the flexible limbs;

means to disengage said means to latch said first cam pulley, and means to transfer the intermediate and final deformation energies stored in the flexible limbs via said tackle line, through said first and additional cam pulleys, to said draw pulley mechanism, and to the draw string to launch an arrow.

13. The archery bow of claim 12 wherein said tackle line pulley assembly provides that each of the draws of the draw string requires approximately the same amount of draw force to draw the draw string from a resting position to a full drawn position.

14. The archery bow of claims wherein said the upper idler pulley is attached to the free end of the upper flexible limb and said lower idler pulley is attached to the free end of the lower flexible limb.

15. The archery bow of claim 12 further comprising an upper rigid limb being attached to the upper end of the handle-riser and having said upper idler pulley attached thereto, and also further comprising a lower rigid limb being attached to the lower end of the handle-riser and having said lower idler pulley attached thereto.

16. The archery bow of claim 15 wherein said rigid limbs provide that while moving between fully drawn and resting position a change in perimetric length of the draw string extending from said block and tackle mechanism through said upper idler pulley to a nocking point on the draw string is equal to a change in perimetric length extending from said block and tackle mechanism through said lower idler pulley to the nocking point on the draw string, the equal changes in perimetric lengths providing equal pay-out and take-up of said tackle line from said block and tackle mechanism to said nocking point providing that said nocking point of the draw string travels on a straight line parallel with a center-line of said archery bow to launch an arrow in a straight line.

17. The archery bow of claim 12 wherein said tackle line pulley assembly comprises a plurality of curved cam pulleys for take-up and pay-out of said tackle line and providing a let-off of draw force to the draw string for each of the draws of the draw string when the draw string is in a full drawn position.

18. The archery bow of claim 17 wherein said plurality of cam pulleys comprises a first cam pulley to take up said tackle line during a first full draw and a second cam pulley for take-up of said tackle line during a second full draw as the draw string is drawn from a resting position to a full drawn position two times forming a first full draw and a second full draw prior to launching an arrow.

19. The archery bow of claim 18 wherein said first cam pulley and said second cam pulley provide that the first full draw and the second full draw are drawn from a resting position to a full drawn position with approximately the same average draw force.

20. The archery bow of claim 18 wherein said second cam pulley comprises a cetrifugal tab to reduce noise and vibration during launch of an arrow.

21. The archery bow of claim 17 wherein said plurality of cam pulleys comprise a plurality of cam pulley perimeters that provide force-draw curves for each of the draws of the draw string from a resting position to a full drawn position.

22. The archery bow of claim 21 wherein said plurality of cam pulleys provide that the draws of the draw string are drawn with approximately the same integrated average draw force.

23. The archery bow of claim 21 wherein said plurality of cam pulleys provide that the draws of the draw string are drawn with and integrated average force wherein a first draw has a greater integrated average draw force than subsequent draws of the draw string and a final draw has a lowest integrated average draw force.

24. The archery bow of claim 12 wherein said draw pulley mechanism comprises two axisymmetric pulleys, a first axisymmetric draw pulley attached to a first end of the draw string and a second axisymmetric draw pulley attached to a second end of the draw string said first and second axisymmetric draw pulleys providing for take-up and pay-out of the draw string.

25. The archery bow of claim 12 wherein said draw pulley mechanism comprises variable radius pulleys that supply a favorable force-draw curve to the draw string during each of the draws of the draw string.

26. The archery bow of claim 12 wherein said upper and lower idler pulleys and said upper and lower block pulleys comprise round axisymmetric pulleys with low mass thereby allowing the flexible limbs to return from a dynamic state of deformation to a static state of deformation more rapidly than with said block pulleys or idler pulleys having greater mass.

27. An archery bow for launching an arrow comprising a handle-riser with an upper end connected to an upper flexible limb and a lower end connected to a lower flexible limb, and upper and lower idler pulleys attached to said archery bow to provide passage for a draw string, the draw string being attached to a block and tackle mechanism; and upper and lower block pulleys attached to the upper and lower flexible limbs, respectively, to provide passage for a tackle line, said tackle line passing along the upper and lower block pulleys and attaching to said block and tackle mechanism, and said block and tackle mechanism attached to the handle-riser transfers draw energy from each of a plurality of draws of the draw string from a resting position to a full drawn position via said tackle line into a deformation energy of the flexible limbs, holds at least some of the deformation energy, and transfers all of the deformation energy through said tackle line via said block and tackle mechanism through the draw string to kinetic energy of the arrow.

28. A method for launching an arrow from a bow comprising:

A. drawing a draw string a plurality of draws with a draw force and with an intermediate draw energy and storing said intermediate draw energy in flexible limbs which deform to an intermediate state of deformation using a block and tackle mechanism that provides a let-off of the draw force in a full drawn position;

B. holding the intermediate draw energy with a latch means;

C. returning said draw string to a final resting position using a draw string return spring means;

D. attaching an arrow nock to the nocking point of said draw string;

E. drawing said draw string from the final resting position to a final drawn position with a final draw force and a final draw energy causing said flexible limbs to become further deformed to a final state of deformation storing the final draw energy as final deformation energy of said flexible limbs;

F. digitally activating a safety release to allow the intermediate draw energy to become available to be combined with the final draw energy for delivery to said draw string; and, G. releasing said draw string allowing the intermediate deformation energy and the final deformation energy of said flexible limbs to be delivered to said draw string and converted into kinetic energy of the arrow to launch the arrow with a greater kinetic energy than a standard compound bow requiring a single draw of similar draw force.

29. A method for launching an arrow from a bow comprising the steps:

A. drawing a draw string from a first resting position to a first full drawn position with a first draw force and a first draw energy and storing the first draw energy in flexible limbs which deform to an intermediate state of deformation using a block and tackle mechanism;

B. holding the first draw energy with a latch means that is activated automatically;

C. returning said draw string to a second resting position using a draw string return spring means;

D. attaching an arrow nock to the nocking point of said draw string;

E. drawing said draw string from the second resting position to a second full drawn position with a second draw force and a second draw energy causing said flexible limbs to become further deformed to a final state of deformation storing the second draw energy as deformation energy of said flexible limbs;

F. digitally activating a safety release to make the draw energy from the first draw available to be combined with the second draw energy to form a total deformation energy for delivery to said draw string; and, G. releasing said draw string allowing the total deformation energy of said flexible limbs to be delivered to said draw string and converted into kinetic energy of the arrow.

30. A method of operation of an archery bow comprising;

A. drawing a draw string a plurality of draws with a draw force and with an intermediate draw energy and storing said intermediate draw energy in flexible limbs which deform to an intermediate state of deformation using a block and tackle mechanism that provides a let-off of the draw force in a full drawn position;

B. holding the intermediate draw energy with a latch means;

C. returning said draw string to a final resting position using a draw string return spring means;

D. attaching an arrow nock to the nocking point of said draw string;

E. drawing said draw string from the final resting position to a final drawn position with a final draw force and a final draw energy causing said flexible limbs to become further deformed to a final state of deformation storing the final draw energy as final deformation energy of said flexible limbs;

F. digitally activating a safety release to allow the intermediate draw energy to become available to be combined with the final draw energy for delivery to said draw string;

G. deactivating said safety release; and,

H. returning said draw string and the arrow from the final drawn position to the final resting position at a force similar to the final draw force without launching the arrow.

31. An archery bow comprising a handle-riser with an upper and lower end, said upper and lower ends being attached to upper and lower flexible limbs, respectively, and the handle-riser being connected to a block and tackle mechanism; said archery bow providing two or more full draws of a draw string, the draw string being connected to said block and tackle mechanism via passage along an upper and a lower idler pulley positioned on said archery bow; a tackle line having passage along an upper and a lower block pulley positioned on the upper and lower flexible limbs, respectively, said tackle line being attached to said block and tackle mechanism, the draw string being drawn at a lower draw force than a draw force from a standard compound bow of similar launch force; first and intermediate full draws of the draw string transfers an intermediate draw energy through said block and tackle mechanism and via said tackle line to the upper and lower flexible limbs to store an intermediate deformation energy in the flexible limbs; means to latch said tackle line to maintain the intermediate deformation energy in the flexible limbs, while allowing the draw string to be relaxed without launching an arrow; a final full draw of the draw string transfers a final draw energy through said block and tackle mechanism and via said tackle line to the upper and lower flexible limbs to store a final deformation energy in the flexible limbs; means to disengage said means to latch said tackle line, which makes the intermediate deformation energy available to be combined with the final deformation energy for transfer to the draw string to launch an arrow with the draw string at a launch force that is higher than a launch force of a standard compound bow of similar draw force.

* * * * *